US006500607B2

(12) United States Patent
Saitou et al.

(10) Patent No.: US 6,500,607 B2
(45) Date of Patent: Dec. 31, 2002

(54) SILVER HALIDE PHOTOGRAPHIC MATERIAL

(75) Inventors: Mitsuo Saitou, Kanagawa (JP); Yoichi Maruyama, Kanagawa (JP); Toshiyuki Nabeta, Kanagawa (JP); Masaaki Miki, Kanagawa (JP); Keiichi Miyazaki, Kanagawa (JP); Mikio Ihama, Kanagawa (JP); Shunji Takada, Kanagawa (JP); Norihiro Omae, Kanagawa (JP); Yasushi Tanabe, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/478,437

(22) Filed: Jan. 6, 2000

(65) Prior Publication Data

US 2002/0058214 A1 May 16, 2002

(30) Foreign Application Priority Data

| | | |
|---|---|---|
| Jan. 8, 1999 | (JP) | 11-003264 |
| Mar. 29, 1999 | (JP) | 11-086096 |
| Mar. 30, 1999 | (JP) | 11-089443 |
| Sep. 30, 1999 | (JP) | 11-280207 |

(51) Int. Cl.[7] ..... G03C 1/10

(52) U.S. Cl. ..... 430/567; 430/569; 430/586; 430/599

(58) Field of Search ..... 430/567, 569, 430/599, 506

(56) References Cited

U.S. PATENT DOCUMENTS

| | | | | | |
|---|---|---|---|---|---|
| 4,275,103 | A | * | 6/1981 | Tsubusaki et al. | 428/148 |
| 4,416,963 | A | * | 11/1983 | Takimoto et al. | 430/69 |
| 4,495,276 | A | * | 1/1985 | Takimoto et al. | 430/527 |
| 4,999,276 | A | * | 3/1991 | Kuwabara et al. | 430/264 |
| 5,719,016 | A | * | 2/1998 | Christian et al. | 430/530 |
| 5,731,119 | A | * | 3/1998 | Eichorst et al. | 430/63 |
| 5,891,612 | A | * | 4/1999 | Nair et al. | 430/530 |
| 6,027,869 | A | * | 2/2000 | Maskasky et al. | 430/567 |

FOREIGN PATENT DOCUMENTS

| | | | |
|---|---|---|---|
| EP | 0930532 A1 | 7/1999 | G03C/1/95 |
| JP | 10-62904 | 3/1998 | G03C/1/815 |

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

A silver halide photographic material is disclosed, comprising a support having provided thereon at least one silver halide emulsion layer, wherein the silver halide emulsion layer contains, in the dispersion medium phase of the emulsion, one or more kinds of inorganic fine particles having a refractive index the total weight of the fine particles contained in the unit volume of the dispersion medium phase is from 1.0 to 95 wt %, the dispersion medium phase containing the fine particles is substantially transparent to the photosensitive peak wavelength light of the emulsion layer, and the photographic material is exposed and processed in the development process comprising at least a developing step and a fixing step.

16 Claims, 9 Drawing Sheets

RELATIONSHIP BETWEEN THICKNESS OF TABULAR GRAIN AND REFLECTANCE OF LIGHT (AMOUNT COATED AS SILVER: 0.8g/m$^2$)

RELATIONSHIP BETWEEN THICKNESS OF TABULAR GRAIN AND REFLECTANCE OF LIGHT (AMOUNT COATED AS SILVER: 0.8g/m$^2$)

RELATIONSHIP BETWEEN THICKNESS OF TABULAR GRAIN AND REFLECTANCE OF LIGHT (AMOUNT COATED AS SILVER: 0.8g/m$^2$)

SILVER HALIDE PHOTOGRAPHIC MATERIAL

FIELD OF THE INVENTION

The present invention relates to a silver halide (hereinafter referred to as "AgX") photographic material which is useful in the field of photography, and particularly relates to a photographic material improved in sensitivity and image quality.

BACKGROUND OF THE INVENTION

It has been required to further improve sensitivity and image quality of photographic materials. When tabular AgX grains are used in photographic materials, the main planes of tabular grains are oriented in parallel to the support, leading to the thinning of the AgX emulsion layer. The improvement of sharpness and speed-up of development have been contrived by making use of this property. There is a maleficent effect of image quality deterioration due to light reflection by interrelation between a tabular grain and an incident light. However, further improvement of sensitivity and image quality has been required by dissolving this problem.

Coherence of the thickness of a tabular grain and a monochromatic light is described in *Research Disclosure*, No. 25330, May (1985), but there is no description with respect to the specific way of improvement by making use of that characteristic.

There are disclosed in JP-A-6-43605 (the term "JP-A" as used herein means an "unexamined published Japanese patent application") the fact that the thickness of the tabular grain in the photosensitive layer farthermost from the exposure light source makes the light reflection in the photosensitive spectrum region of the emulsion the smallest, and the embodiment of also making the thicknesses of the tabular grain in other photosensitive layers optimal in the photosensitive wavelength region of the photosensitive layer to make the light reflection the smallest, but the improving effect of sensitivity and image quality is small only with these embodiments.

When reflection occurs by the incident light from a dispersion medium layer to an AgX layer, in general, the electric field vector of the incident wave and the electric field vector of the reflected wave are in opposite directions and they offset each other, as a result, the light strength on the vicinity of the interface weakens. There is hence the disutility that the light absorption amount of the sensitizing dye adsorbed onto the interface is inhibited, and the improvement of this disutility is also demanded.

The image quality variation of a red-sensitive layer by changing the location of the red-sensitive layer in a color photographic material comprising a blue-sensitive layer, a green-sensitive layer and a red-sensitive layer is described in *Journal of Imaging Science and Technology*, Vol. 38, pp. 32 to 35 (1994). If the location of a red-sensitive layer is changed, however, the image qualities of other photosensitive layers are deteriorated and the entire color balance also lowers, which produces a disadvantageous result.

Addition of $TiO_2$ particles having a primary particle diameter of from 1 to 100 nm to a photo-insensitive layer as a UV absorber is disclosed in JP-A-10-62904, U.S. Pat. Nos. 5,731,136 and 5,736,308. They propose to use $TiO_2$ particles which are not deteriorated with the lapse of time as a UV absorber in place of conventional organic UV absorbers which are deteriorated with aging, and to use $TiO_2$ particles in a layer nearer to the light source than the color image-forming layer. They also propose to use as the $TiO_2$ those described in Gunter Buxbaum, *Industrial Inorganic Pigments*, pp. 227 to 228, VCH Weinheim, Tokyo (1993). These particles certainly comprise small primary particles, but they are particles in which 90 mol % or more of the entire particles are occupied by particles comprising 30 or more primary particles which are three dimensionally agglomerated with one another and having three dimensional structure. They are inappropriate particles for the object of the present invention. Further, the foregoing patents do not aim to inhibit light scattering of AgX grains by increasing the refractive index of the binder in a photosensitive layer, so that this technique is different from the object of the present invention.

A technique of mixing a colloidal silica to an AgX emulsion layer to improve a pressure characteristic is disclosed in JP-A-4-241551 and JP-A-5-53237, and a technique of super-rapid low replenishing development process is disclosed in JP-A-9-269560. However, the refractive index of the foregoing colloidal silica to the light having a wavelength of 500 nm is lower than that of gelatin (1.546), therefore, this technique cannot make the refractive index of a dispersion medium layer high.

On the other hand, a silver halide photographic material containing $TiO_2$ fine particles in the emulsion layer is disclosed in EP-A-930532 but this technique is different from the technique of the present invention in the point that the above photographic material is not subjected to desilvering processing after development.

SUMMARY OF THE INVENTION

An object of the present invention is to provide a silver halide photographic material which is further improved in sensitivity and image quality.

The above object of the present invention has been achieved by the following items (i.e., the following embodiments and preferred embodiments of the present invention).

(I) Embodiments of the Present Invention (1) A silver halide photographic material comprising a support having provided thereon at least one silver halide emulsion layer, wherein the silver halide emulsion layer contains, in the dispersion medium phase of the emulsion, one or more kinds (preferably from 1 to 20 kinds, and more preferably from 2 to 10 kinds) of inorganic fine particles having a refractive index of from 1.62 to 3.30(preferably from 1.70 to 3.30, and more preferably from 1.80 to 3.10) to the light having a wavelength of 500 nm, the total weight of the fine particles contained in the unit volume of the dispersion medium phase is from 1.0 to 95 wt % (preferably from 5 to 90 wt %, and more preferably from 15 to 70 wt %), the dispersion medium phase containing the fine particles is substantially transparent to the photosensitive peak wavelength light of the emulsion layer, and the photographic material is exposed and processed in the development process comprising at least a developing step and a fixing step. The silver halide photographic material preferably has the refractive index of the dispersion medium phase to the light having a wavelength of 500 nm higher by 0.05 to 0.90 (preferably from 0.12 to 0.90, and more preferably from 0.20 to 0.90) than the refractive index of the time when the dispersion medium phase does not contain the inorganic fine particles, the light reflection strength of the emulsion layer to the photosensitive peak wavelength light of the emulsion layer is reduced due to the presence of the fine particles to 0.0 to 95% (preferably from 0.0 to70%, and more preferably from 2.0 to 40%) of the light reflection strength of the time when the emulsion layer does not contain the inorganic fine particles, and the below-described $Z_1$ value of the entire photographic image finally obtained through all the steps of development process is from 0.0 to 0.70 (preferably from 0.0 to 0.20, more preferably from 0.0 to 0.0S, and most preferably from 0.0 to 0.010).

$Z_1$=[(the molar rate of the silver halide remaining in the finally obtained entire photographic image)/(the molar rate of the silver halide remaining in the entire photographic image obtained after development alone)]

(2) The silver halide photographic material as described in the above item (1), wherein from 50 to 100% (preferably from 80 to 100%, and more preferably from 95 to 100%) of the total projected area of the silver halide grains in the at least one silver halide emulsion layer are tabular grains having an aspect ratio (diameter/thickness) of from 2.0 to 300 ( preferably from 4.0 to 300, and more preferably from 4.0 to 100), a thickness of from 0.01 to 0.50 $\mu$m (preferably from 0.01 to 0.30 $\mu$m), and a diameter of from 0.1 to 30 $\mu$m (preferably from 0.1 to 10 $\mu$m, and more preferably from 0.1 to 5.0 $\mu$m).

(3) The silver halide photographic material as described in the above item (2), wherein the tabular grains have a variation coefficient of thickness distribution of from 0.01 to 0.30 (preferably from 0.01 to 0.20), and a variation coefficient of diameter distribution of from 0.01 to 0.30 (preferably from 0.01 to 0.20, and more preferably from 0.01 to 0.10).

(4) The silver halide photographic material as described in the above item (1), (2) or (3), wherein the number of the inorganic fine particles is from 0.5 to $10^{12}$ (preferably from 2.0 to $10^{12}$, and more preferably from 10 to $10^{12}$) per one tabular grain.

(5) The silver halide photographic material as described in the above item (1), (2), (3) or (4), wherein the photographic material is a color photographic material comprising a support having multilayer-coated thereon at least a blue-sensitive layer, a green-sensitive layer and a red-sensitive layer.

(6) The silver halide photographic material as described in the above item (5), wherein the blue-sensitive layer, green-sensitive layer and red-sensitive layer respectively comprise one or more layers, and when taking it that the blue-sensitive layer comprises $B_1$, $B_2$, $B_3$ . . . $B_{m1}$, green-sensitive layer-comprises $G_1$, $G_2$, $G_3$ . . . $Gm_1$, and red-sensitive layer comprises $R_1$, $R_2$, $R_3$ . . . $R_{m1}$, in order nearer to the subject, the silver halide grains in one to three layers (preferably two or three layers, and more preferably three layers or three sets of layers) of $B_1$, $G_1$ and $R_1$, [preferably ($B_1$ and $B_2$), ($G_1$ and $G_2$), and ($R_1$ and $R_2$), more preferably ($B_1$, $B_2$ and $B_3$), ($G_1$, $G_2$ and $G_3$), and ($R_1$, $R_2$ and $R_3$), and still more preferably ($B_1$, $B_2$, $B_3$ . . . $B_{m1}$), ($G_1$, $G_2$, $G_3$. . . $G_{m1}$), and ($R_1$, $R_2$, $R_3$ . . . $R_{m1}$)], are tabular grains as described in the above item (2) or (3).

(7) The silver halide photographic material as described in the above item (5) or (6), wherein the blue-sensitive layer is arranged nearest to the subject, the blue-sensitive layer comprises one or more layers, the silver halide grains contained in at least the layer having the highest sensitivity of the one or more layers are tabular grains as described in the above item (2), and the thickness of the tabular grains is prescribed so that the reflected light strength ($A_3$) to the photosensitive peak wavelength light of the green-sensitive layer and the photosensitive peak wavelength light of the red-sensitive layer falls within the range defined by equation (a-1): Equation (a-1): Main planes of various tabular grains having the same condition excepting the thickness are subjected to incidence at the incident angle of 5° with the beam of the photosensitive peak wavelength light, the reflected light strength is measured in the direction of the reflection angle of 5°, and when the reflected light strength with the highest strength is taken as $A_1$, and the reflected light strength with the lowest strength is taken as $A_2$, the range of the reflected light strength ($A_3$) is defined as $\{A_2 \sim [A_2 + b_1(A_1 - A_2)]\}$, wherein $b_1$ is 0.47, (preferably 0.30, and more preferably 0.12).

(8) A silver halide color photographic material comprising a support having provided thereon at least one red-sensitive silver halide emulsion layer, at least one green-sensitive silver halide emulsion layer, and at least one blue-sensitive silver halide emulsion layer, wherein the silver halide color photographic material satisfies at least one of the following items (i) to (v):

(i) At least one silver halide emulsion layer contains tabular silver halide grains, and the tabular grains have a lower spectral reflectance than the spectral reflectance of the tabular silver chloride grains having the same thickness;

(ii) At least one silver halide emulsion layer contains tabular silver halide grains, the average thickness of the tabular grains is smaller than the thickness of the grains in the layer which give the maximum value of spectral reflectance, and the spectral reflectance at the average thickness is 90% or less of the maximum value of spectral reflectance;

(iii) In the above item (ii), the silver halide grains having equivalent-circle diameter of 0.6 $\mu$m or less accounts for 20% or less of the silver halide grains in the layer in terms of the projected area;

(iv) At least one spectral sensitive silver halide emulsion layer comprises two or more emulsion layers containing tabular grains, and the average grain thickness of the silver halide grains contained in at least one layer of these two or more layers other than the layer farthest from the support falls within the range of the thickness which gives the spectral reflectance of 80% or more of the maximum spectral reflectance of the tabular grains; and (v) In the above item (iv), the layer farthest from the support satisfies the condition in item (ii) or (iii).

(9) A silver halide color photographic material comprising a support having provided thereon at least one red-sensitive silver halide emulsion layer, at least one green-sensitive silver halide emulsion layer, and at least one blue-sensitive silver halide emulsion layer, wherein at least one silver halide emulsion layer contains inorganic fine particles having a particle diameter of 100 nm or less and tabular silver halide grains having a thickness of less than 0.09 $\mu$m.

(10) The silver halide photographic material as described in the above item (8), wherein at least one silver halide emulsion layer contains inorganic fine particles having a particle diameter of 100 nm or less.

Other preferred embodiments of the present invention are described below.

(11) The silver halide photographic material as described in the above item (5), wherein the green-sensitive layer comprises one or more layers, the silver halide grains contained in at least the layer having the highest sensitivity of the one or more layers are tabular grains as described in the above item (2), and the thickness of the tabular grains is prescribed so that the reflected light strength to the photosensitive peak wavelength light of the red-sensitive layer falls within the range defined by equation (a-1).

(12) The silver halide photographic material as described in the above item (5), wherein the red-sensitive layer comprises one or more layers, the silver halide grains contained in at least the layer having the highest sensitivity of the one or more layers are tabular grains as described in the above item (2), and the thickness of the tabular grains is prescribed so that the reflected light strength to the photosensitive peak wavelength light of the red-sensitive layer falls within the range defined by equation (a-1).

(13) The silver halide photographic material as described in the above item (5), wherein the blue-sensitive layer comprises from 2 to 7 layers, preferably from 3 to 5 layers, and when taking it that the blue-sensitive layer comprises first layer, second layer . . . $m_1$th layer, in order from the highest sensitivity, the AgX grains in each layer of the second layer, preferably the second and the third layers, and more preferably the second layer . . . the $m_1$th layer, are tabular grains as described in the above item (2), and the thickness of the tabular grains is prescribed so that the reflected light strength to the photo-sensitive peak wavelength light of the green-sensitive layer and the photosensitive peak wavelength light of the red-sensitive layer falls within the range defined by equation (a-1).

(14) The silver halide photographic material as described in the above item (5), wherein the green-sensitive layer comprises from 2 to 7 layers, preferably from 3 to 5 layers, and when taking it that the green-sensitive layer comprises first layer, second layer . . . $m_1$th layer, in order from the highest sensitivity, the AgX grains in each layer of the second layer, preferably the second and the third layers, and more preferably the second layer . . . the math layer, are tabular grains as described in the above item (2), and the thickness of the tabular grains is prescribed so that the reflected light strength to the photosensitive peak wavelength light of the red-sensitive layer falls within the range defined by equation (a-1).

(15) The silver halide photographic material as described in the above item (5), wherein the red-sensitive layer comprises from 2 to 7 layers, preferably from 3 to 5 layers, and when taking it that the red-sensitive layer comprises first layer, second layer . . . $m_1$th layer, in order from the highest sensitivity, the AgX grains in each layer of the second layer, preferably the second and the third layers, and more preferably the second layer . . . the $m_1$th layer, are tabular grains as described in the above item (2), and the thickness of the tabular grains is prescribed so that the reflected light strength to the photo-sensitive peak wavelength light of the red-sensitive layer falls within the range defined by equation (a-1).

(16) The silver halide photographic material as described in the above item (5), wherein the thickness of the tabular grains in the first blue-sensitive layer, preferably the first layer and the second layer, is prescribed so that the reflected light strength to the photosensitive peak wavelength light of the blue-sensitive layer falls within the range defined by equation (a-1), wherein $b_1$ is 0.70, preferably 0.55.

(17) The silver halide photographic material as described in the above item (1), wherein the photographic material has one or more photosensitive layers, at least one photosensitive layer comprises two or more AgX-containing emulsion layers, and when taking it that the AgX-containing emulsion layer comprises first layer, second layer . . . $m_1$th layer, in order nearer to the subject, at least one layer of the second layer to the lowest rank layer is a reflective layer in order to effectively reflect the photosensitive layer, the AgX grains contained in the reflective layer are tabular grains as described in the above item (2), and when taking it that the average grain diameter of the AgX grains contained in the layer ahead of one is $d_1$, the average value $d_2$ is from $1.10d_1$ to $100d_1$, preferably from $1.50d_1$ to $100d_1$, more preferably from $2.0d_1$ to $100d_1$, and still more preferably from $4.0d_1$ to $100d_1$.

(18) The silver halide photographic material as described in the above item (17), wherein the thickness of the tabular grains contained in the reflective layer is prescribed so that the reflected light strength ($A_4$) to the photosensitive peak wavelength light of the photosensitive layer falls within the range defined by the following equation (a-2): Equation (a-2) Main planes of various tabular grains having the same condition excepting the thickness are subjected to incidence at the incident angle of 5° with the beam of light of the photosensitive peak wavelength light, the reflected light strength is measured in the direction of the reflection angle of 5°, and when the reflected light strength with the highest strength is taken as $A_1$, and the reflected light strength with the lowest strength is taken as $A_2$, the range of said reflected light strength ($A_4$) is defined as $\{A_1 \sim [A_1 + b_2(A_1 - A_2)]\}$, wherein $b_1$ is 0.47, preferably 0.30, and more preferably 0.20.

(19) The silver halide photographic material as described in the above item (18), wherein the sensitivity of the tabular grains contained in the lowest layer (a sample monolayer-coated on a transparent support is exposed through an optical wedge with the photosensitive peak wavelength light of the photosensitive layer, development processed, and when the exposure amount giving the middle point density on the characteristic curve of the sample obtained is taken as (E1), a log(E1) value is the sensitivity) is higher by 0.10 to 2.0, preferably by 0.2 to 1.0, than the sensitivity of the tabular grains contained in the layer of a rank ahead of one (a-log(E2) value obtained by the same definition).

(20) The silver halide photographic material as described in the above item (2) or (3), wherein the tabular grains have {111} planes as main planes and two twin planes parallel to the main planes, the distance between the twin planes is from 0.3 to 50 nm, preferably from 0.3 to 30 nm, the configuration of the main planes are hexagons, or hexagons having rounded corners, and a ratio of adjacent side lengths of the hexagon or a hexagon formed by prolonging the straight lines of the sides ((a side length of the longest side/a side length of the shortest side) in one tabular grain) is from 1.0 to 2.0.

(21) The silver halide photographic material as described in the above item (2) or (3), wherein the tabular grains have {100} planes as main planes, the configuration of the main planes are right angled parallelograms or right angled parallelograms having rounded corners, and a ratio of adjacent side lengths of the parallelogram or a parallelogram formed by prolonging the straight lines of the sides ((a side length of the longest side/a side length of the shortest side) in one tabular grain) is from 1.0 to 3.5, preferably from 1.0 to 2.0.

(22) The silver halide photographic material as described in the above item (2), wherein the tabular grains have an epitaxial part (which is called a guest grain) on the peripheral part of the projected configuration which is different in a Cl content, a Br content or an I content from the average halogen composition of the surface layer of the tabular grain (a layer of a distance of from 0 to 3.0 nm from the surface of the grain) by 5.0 to 100 mol % (preferably from 20 to 100 mol %, and more preferably from 40 to 100 mol %), the total amount of the epitaxial part is from 0.001 to 0.30 (preferably from 0.003 to 0.20) per mol of the host grain, and the peripheral part is the region from 60 to 100% (preferably from 80 to 100%, and more preferably from 90 to 100%) of the distance in a straight line from the central part to the peripheral part with the central part as the starting point.

(23) The silver halide photographic material as described in the above item (1), wherein the inorganic fine particles are pulverized in an aqueous solution containing from 001to 10 wt % (preferably from0.1 to 5.0 wt% ), of a water-soluble dispersion medium containing one or more of a water-soluble polymer, a surfactant, a photographic antifoggant, an onium base-containing compound, a phosphoric acid, a silicic acid, and an organic acid), and the pulverized size of the inorganic fine particles is from $10^{8-}$to 0.5 times (preferably from $10^{8-}$to 0.1 times) of the original average volume.

(24) The silver halide photographic material as described in the above item (1) or (2), wherein from 10 to 100% (preferably from 30 to 100%, and more preferably from 60 to 100%) of the entire molar amount of the inorganic fine particles are titanium oxide, and when Fe is contained, the weight of $Fe_2O_3$ based on ($TiO_2$+$Fe_2O_3$) is from 0.0 to 1.0 wt % (preferably from 0.0 to 0.5 wt %, and more preferably from 0.0 to 0.1 wt %).

Figure 1:
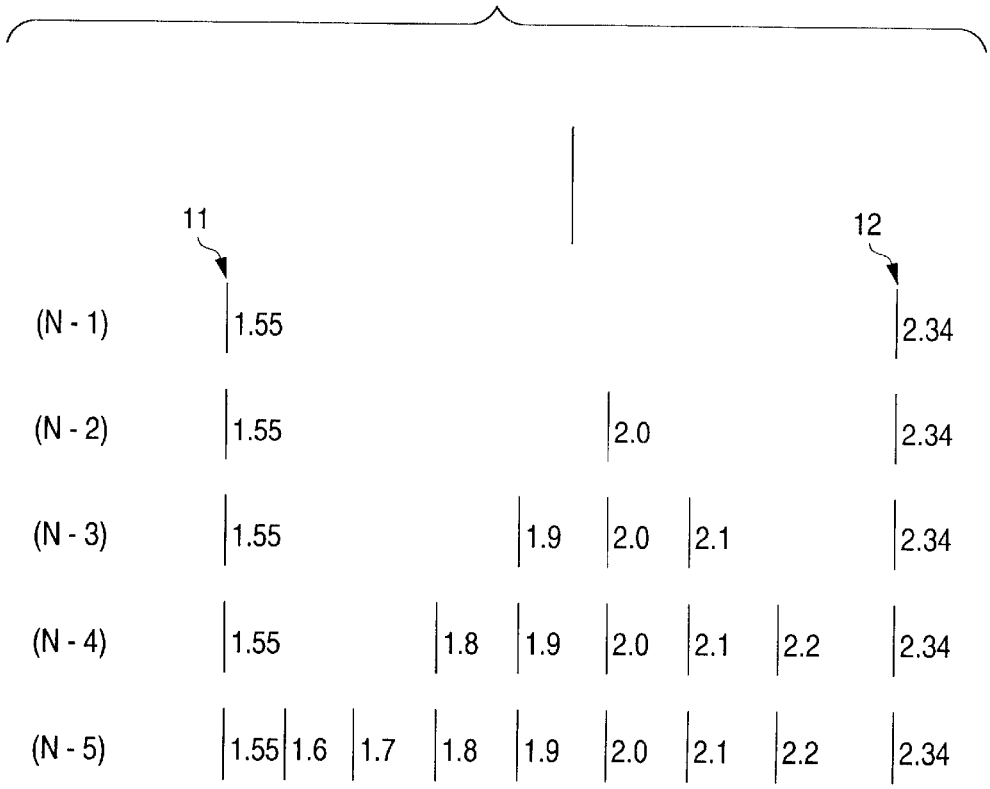
FIG. 1 shows the refractive index structure of the interlayer between the protective layer surface and the main plane of an AgBr tabular grain of a photographic material.

Key to the Symbols:

In FIG. 1, 11: a protective layer surface, 12: a main plane of an AgBr tabular grain and, (N-1) to (N-5): five embodiments.

Figure 2:
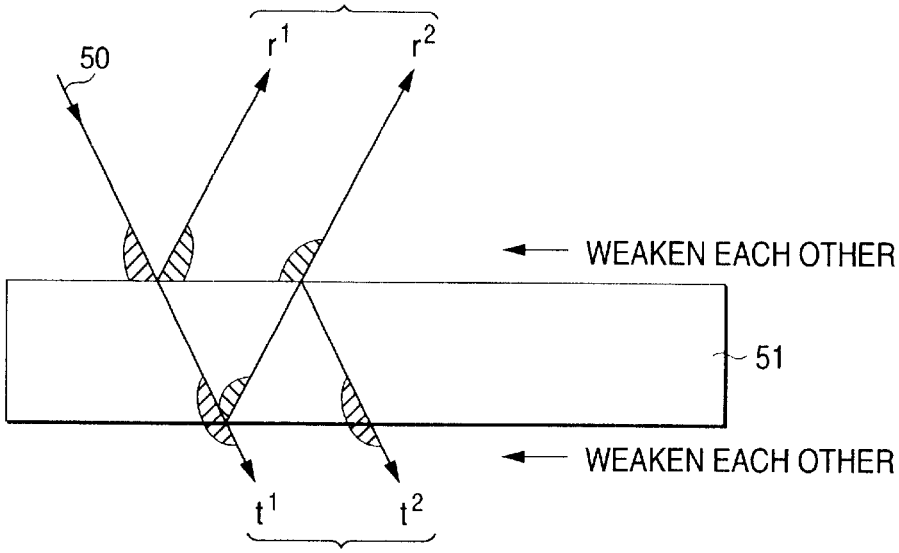
FIGS. 2(*a*) and 2(*b*) shows the coherent effect of a beam of light to a tabular grain.
Figure 2:
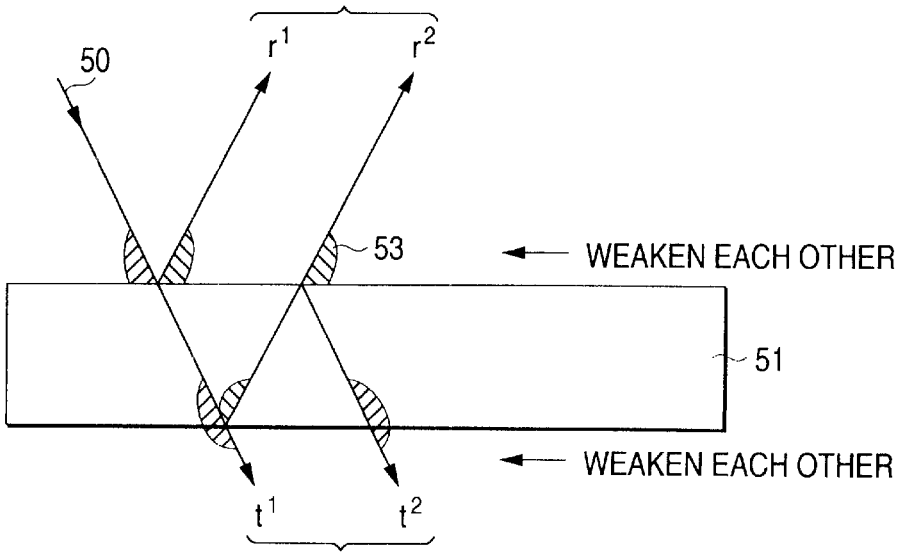

In FIG. 2, 50: an incident light, $r^1$: a primary reflected light, $r^2$: a secondary reflected light, $t^1$: a primary transmitted light, $t^2$: a secondary transmitted light, 51: a tabular grain and, 53: the amplitude wave of the electric field of light.

DETAILED DESCRIPTION OF THE INVENTION

Items (1) to (24) in (I) above will be described in detail below.

(II) Explanation of AgX Emulsion and Layer Constitution (II-1) AgX Emulsion and Layer Constitution AgX grains in the present invention mean every conventionally known AgX grain. AgX compositions include AgCl, AgBr, AgI and every mixed crystal of two or more of these. Tabular grains having a diameter (μm) of from 0.05 to 10 μm, preferably from 0.10 to 5.0 μm, and an aspect ratio of from 2.0 to 300, and non-tabular grains having an aspect ratio of 1.0 to less than 2.0 can be exemplified, and preferably the tabular grains described in the above items (2) and (3) can be exemplified. Other than the above, a grain having dislocation lines inside the grain, a grain having structure with a grain having a uniform halogen composition (e.g., a double structural grain and a multiple structural grain), and an epitaxial grain comprising a host grain having an epitaxially grown part thereon can be exemplified. When grains are classified by the position of a latent image formed by exposure, the following AgX grains can be exemplified, e.g., a surface latent image type grain mainly having a latent image on the surface of a grain, a shallow internal latent image type grain mainly having a latent image inside of a grain within 500 Å from the surface of a grain, an internal latent image type grain mainly having a latent image inside of a grain 501 Å or more from the surface of a grain, and a core/shell type internal latent image type grain.

As the photographic materials according to the present invention, AgX color photographic materials (e.g., a color negative photographic material, a direct positive color photographic material, a color reversal photographic material, a diffusion transfer color photographic material, and a heat-developable color photographic material), and AgX black-and-white photographic materials (e.g., an X-ray film and a photographic material for printing) can be exemplified. In the case of color photographic materials, a blue-sensitive layer (B), a green-sensitive layer (G), a red-sensitive layer (R), and a support (S) can take the layer constitution in order of (B|R|G|S), (G|B|R|S), (G|R|B|S), (R|G|B|S), (R|B|G|S), or (B|G|R|S), and (B|G|R|S) is more preferred. In this case, a blue-sensitive layer is arranged nearest to the subject. In these cases, the fourth photosensitive layer described later can be incorporated at any position.

(II-2) Explanation of Tabular Grains

The thickness of a tabular grain means a distance between two main planes of a tabular grain. The diameter of a tabular grain means the diameter of a circle having the same area with the projected area of the grain when the main plane is placed in parallel to the substrate and observed from the vertical direction.

As the tabular grains, {111} tabular grains having {111} faces as main planes and two or more twin planes parallel to each other inside of the grain, and {100} tabular grains having {100} faces as main planes can be exemplified. The AgX composition of these tabular grains include AgCl, AgBr, AgBrI, AgClI and mixed crystals of two or more of these AgX compositions, and AgX composition is not particularly restricted. Grains having uniform AgX composition, double structural grains comprising a core part and a shell part each having different AgX composition, and multiple structural grains comprising three or more layers, preferably from three to five layers, in which adjacent layers respectively have different AgX compositions, can be exemplified. Further, there can be exemplified tabular grains having a higher AgI content in the peripheral part than in the central part, i.e., tabular grains in which the AgX composition in the peripheral part is more sparingly soluble than that in the central part,-and supposing that (the solubility of the average AgX composition in the central region of from 0 to 40%, preferably from 0 to 25%, of the shortest distance of a straight line joining from the central part to the peripheral part/the solubility of the average AgX composition in the region of from 80 to 100% of the shortest distance) with the central part as the starting point is taken as $A_{10}$, $A_{10}$ is preferably from 1.5 to $10^3$ times, more preferably from 3 to $10^2$ times.

The embodiment that tabular grains have one or more, preferably from 2 to 50, dislocation lines in the inside of the grains, the peripheral part of the tabular grains has more dislocation lines than the central part, and from 60 to 100%, preferably from 85 to 100%, of the entire dislocation lines are present in the peripheral region described in the above embodiment (I)-(22) can be exemplified. Further, with respect to the place where a latent image is formed (the place where development is initiated), embodiments that a latent image is preferentially formed at the peripheral part of tabular grains, at the central region of tabular grains, further as to the direction of the depth of latent image formation, the above-described surface latent image type grain, shallow internal latent image type grain, and internal latent image type grain can be exemplified "Preferentially formed" used herein means that from 55 to 100%, preferably from 70 to 100%, and more preferably from 85 to 100%, of the latent image is formed at the place. This characteristic corresponds to the place where a chemically sensitized nucleus is formed.

The distance between the adjacent twin planes is preferably from 0.3 to 50 nm, more preferably from 0.3 to 30 nm. The variation coefficient of the distance distribution is preferably from 0.01 to 0.50, more preferably from 0.01 to 0.30, and still more preferably from 0.01 to 0.20. Thickness/distance of the tabular grain is preferably from 1.2 to 500, more preferably from 1.5 to 200.

The configurations of the main planes of the {100} tabular grains may be (1) a right angled parallelogram having a ratio of adjacent side lengths of from 1.0 to 7.0, preferably from 1.0 to 3.5, and more preferably from 1.0 to 2.0, (2) the mode that from 1 to 4, preferably from 1 to 3, of the four corners of the above right angled parallelogram is (are) lacked non-equivalently [the mode that when (the highest lacked area/the smallest lacked area) of the main plane in one grain is taken as $A_{11}$, $A_{11}>2$], (3) the mode that these corners are rounded in shape, (4) the mode that at least two opposite sides of the four sides constituting the main plane are curves forming convexity outward, and (5) the mode that the four corners of the right angled parallelogram are lacked equivalently (the above $A_{11}<2$).

Further, tabular grains whose plane index of the edge plane is different from that of the main plane can be exemplified. For example, tabular grains in which when the main plane is {111} face, from 1.0 to 100%, preferably from 5.0 to 50%, of the entire area of the edge plane is non-{111} face, e.g., {100} face or {110} face, and tabular grains in which when the main plane is {100} face, from 1.0 to 100%, preferably from 5.0 to 50%, of the entire area of the edge plane is non-{100} face, e.g., {111} face or {110} face.

In addition, there can be exemplified tabular grains having an epitaxial part on one or more corners of the tabular grains, preferably on all the corners, which is different in a $Cl^-$ content, a $Br^-$ content or an $I^-$ content from the average halogen composition of the surface layer of the tabular grain by 5.0 to 100 mol %, preferably from 20 to 100 mol %. The surface layer means a layer of a distance of from 0 to 3.0 nm from the surface of the grain.

Tabular grains having uniformly the epitaxial part on the main planes, and tabular grains whose main planes are not flat and having a ruffled face (i.e., a roughness face) can also be exemplified.

The following methods can be exemplified as a method for forming the dislocation defects: 1) a method of forming AgX composition gap faces (faces different in an AgCl, AgBr or AgI content by from 5.0 to 100 mol %), and 2) a method of generating $X^-$ to cause halogen conversion by means of (a) the addition of $Br^-$ or $I^-$, (b) a method of adding AgX fine grain, (c) a method of adding $Br_2$ or $I_2$, and then adding a reducing agent to generate $X^-$, or (d) a method of adding an organic halide, and then adjusting pH of the solution or adding a reducing agent to generate $X^-$.

The AgX emulsion in the reflective layer described in (I) above is preferably a tabular grain emulsion having the following characteristics.

As the tabular grains in the reflective layer, a mode of being spectrally sensitized with a spectral sensitizing dye for the pertinent photosensitive layer ($A_{12}$), and a mode of substantially not being sensitized ($A_{13}$) can be exemplified.

$A_{12}$ is a mode of adding a spectral sensitizing dye in an amount of from 3.0 to 200%, preferably from 10 to 100%, of the saturated adsorption amount, and $A_{13}$ is a mode of adding a spectral sensitizing dye in an amount of from 0 to less than 3.0%, preferably from 0 to less than 1%.

The tabular grains in the reflective layer are adsorbed with a sensitizing dye in an amount of from 40 to 100%, preferably from 60 to 100%, of the saturated adsorption amount of the dye, and from 40 to 100%, preferably from 60 to 100%, and more preferably from 80 to 100%, of the adsorbed dye is adsorbed in J-aggregate (sometimes, called J-association body).

Further, from 50 to 100%, preferably from 80 to 100%, of the J-aggregate is from 6 to limit molecular number (the molecular number of the time when the main plane of a tabular grain is covered with one J-aggregate), preferably from 30 to limit molecular number, and the structure of the aggregate is preferably herringbone structure.

In this case, the larger the size of one J-aggregate, the larger is the reflectance of light, but the wavelength region of the light which reflects becomes narrow. Therefore, it is preferred to use the most preferred size of J-aggregate for the reflectance and the wavelength region. The size of J-aggregate becomes large when an AgX emulsion is ripened in the presence of the dye. The higher the ripening temperature and the longer the ripening time, the larger becomes the size, and generally the ripening temperature is from 40 to 95° C., preferably from 50 to 85° C., and the ripening time is from 3 to 200 hours, preferably from 5 to 100 hours.

In this case, if the thickness of the tabular grain is a thickness defined by equation (a-2), the reflectance advantageously becomes high due to the reflected light by the adsorbed dye and the reflected light by the coherent light of the tabular grain.

When the photosensitive layer is subjected to spectral exposure and development processing, the photosensitive peak wavelength light means a wavelength light giving the maximum optical density on the characteristic curve with the wavelength of light as the abscissa and with the optical density as the ordinate. In general, the peak wavelength of the blue-sensitive layer is from 410 to 480 nm, that of the green-sensitive layer is from 510 to 580 nm, and that of the red-sensitive layer is from 600 to 720 nm.

The incident angle in equations (a-1) and (a-2) means the angle between a normal line standing on the main plane of a tabular grain and the incident light. The photographic material can take any conventionally known layer constitution. This is because as a green-sensitive layer and a red-sensitive layer are also sensitive to a blue light, these layers are preferably arranged under a blue-sensitive layer so as not to be exposed to a blue light, and as a red-sensitive layer is also sensitive to a green light, a red-sensitive layer is preferably arranged under a green-sensitive layer so as not to be exposed to a green light.

It is also possible to provide a fourth photosensitive layer between a blue-sensitive layer and a red-sensitive layer, preferably between a blue light-cutting layer and a red-sensitive layer, to control the degree of coloring of a red-sensitive layer, as described in *Nihon Shashin Gakkai-Shi*, pp. 1 to 8 (1989) With respect to details thereof, U.S. Pat. Nos. 4,663,271, 4,705,744, 4,707,436, JP-A-62-160448, JP-A-63-89850, and Japanese Patent Application No. 11-57097 can be referred to.

The functions of a blue light-cutting layer are 1) to absorb a blue light and transmit a green light and a red light, and 2) to prevent the developing oxidants of a blue-sensitive layer and a green-sensitive layer from diffusing into the adjacent layers, coloring and generating color mixing. For the purpose of cutting a blue light, a method of using AgX fine grains and a colloidal silver which absorb and reflect a blue light, a method of adding a dye which absorbs a blue light to the blue light-cutting layer, and combination of these methods can be used. When a colloidal silver is used, an interlayer can be provided between the blue light-cutting layer and the photosensitive layer to prevent the colloidal silver from being in contact with the AgX grains in the blue-sensitive layer and a green-sensitive layer and thereby generating fog.

The tabular grain emulsion particularly preferably used in the above embodiments (I)-(8) to (I)-(10) will be described in further detail below.

Figure 7:
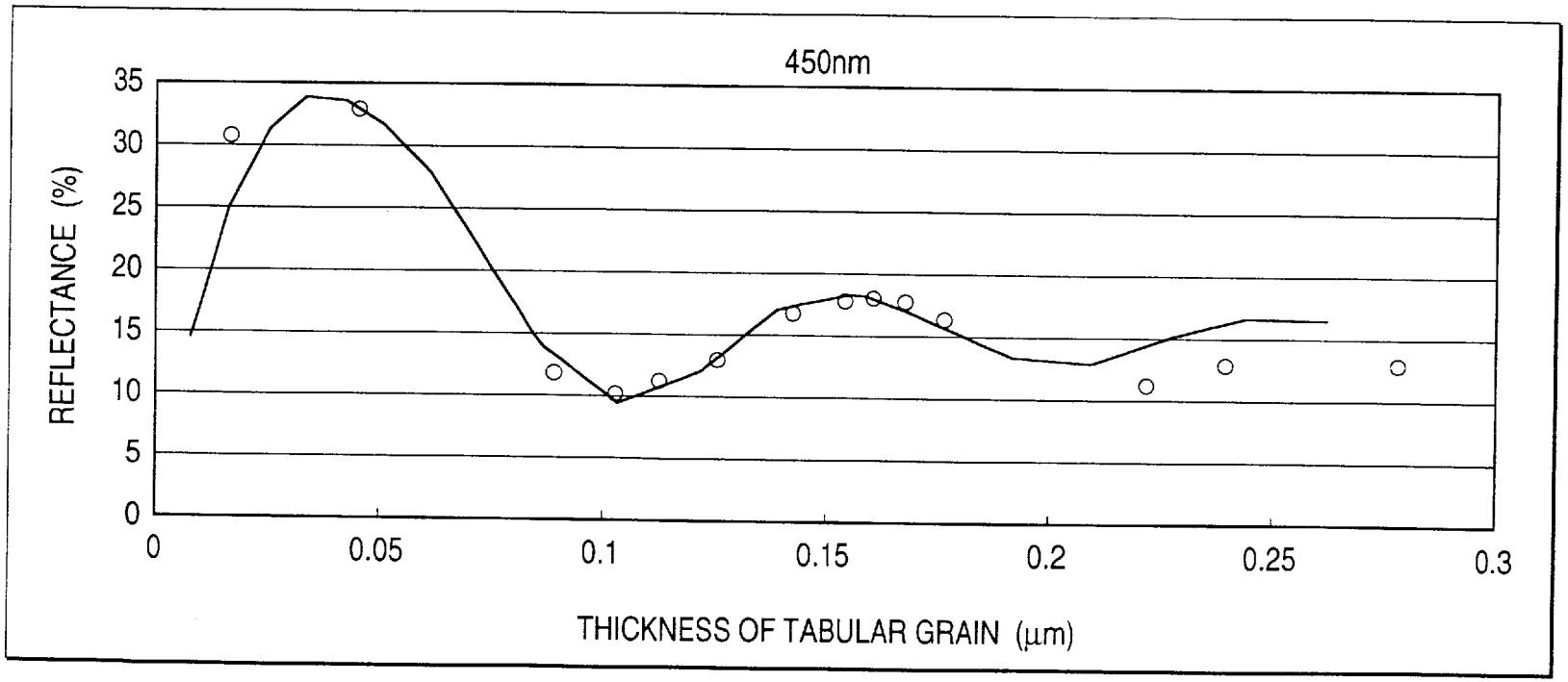
FIG. 7 is a graph showing the relationship between the thickness of a tabular grain and the reflectance of light at an incident light wavelength of 450 nm (wherein o indicates a measured value, a solid line indicates simulation, and the coating amount of silver is 0.8 g/$m^2$, hereinafter the same)
Figure 8:
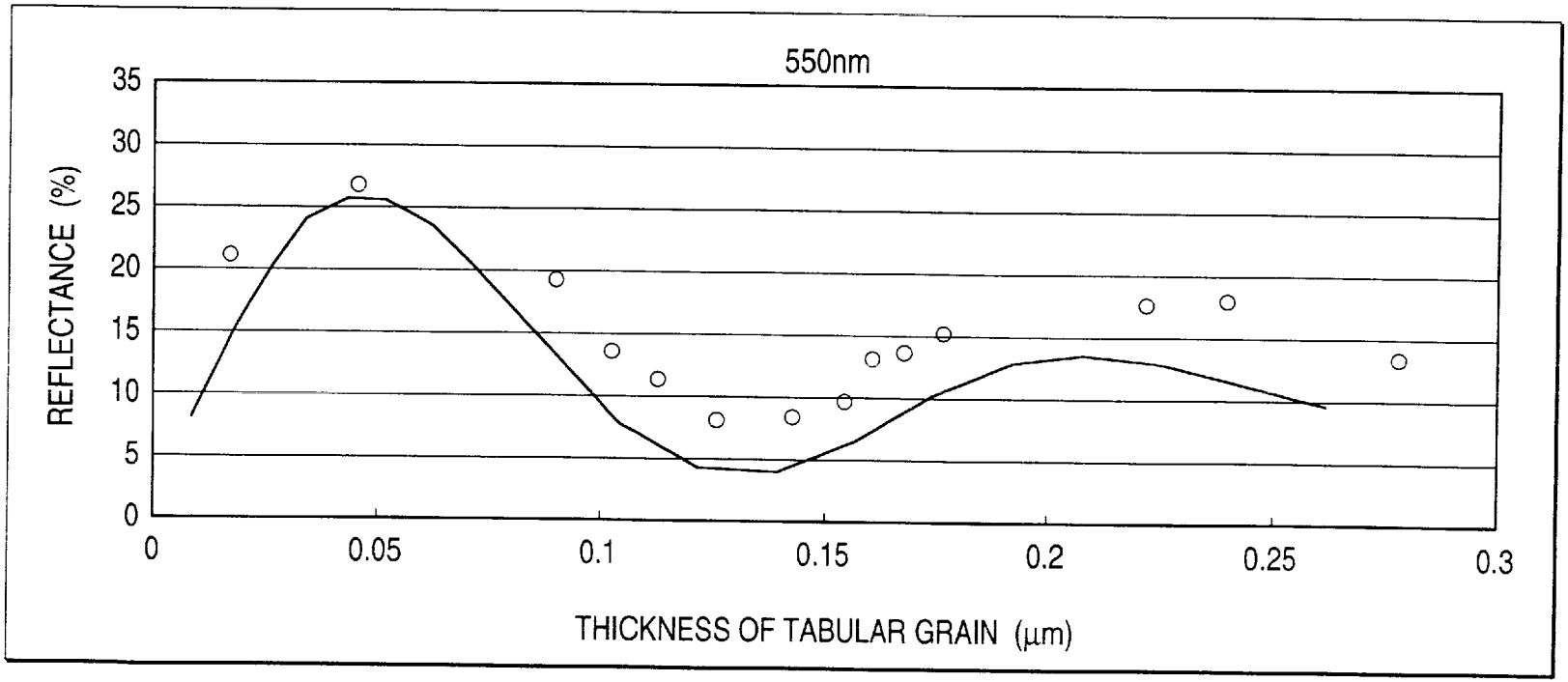
FIG. 8 is a graph showing the relationship between the thickness of a tabular grain and the reflectance of light at an incident light wavelength of 550 nm.
Figure 9:
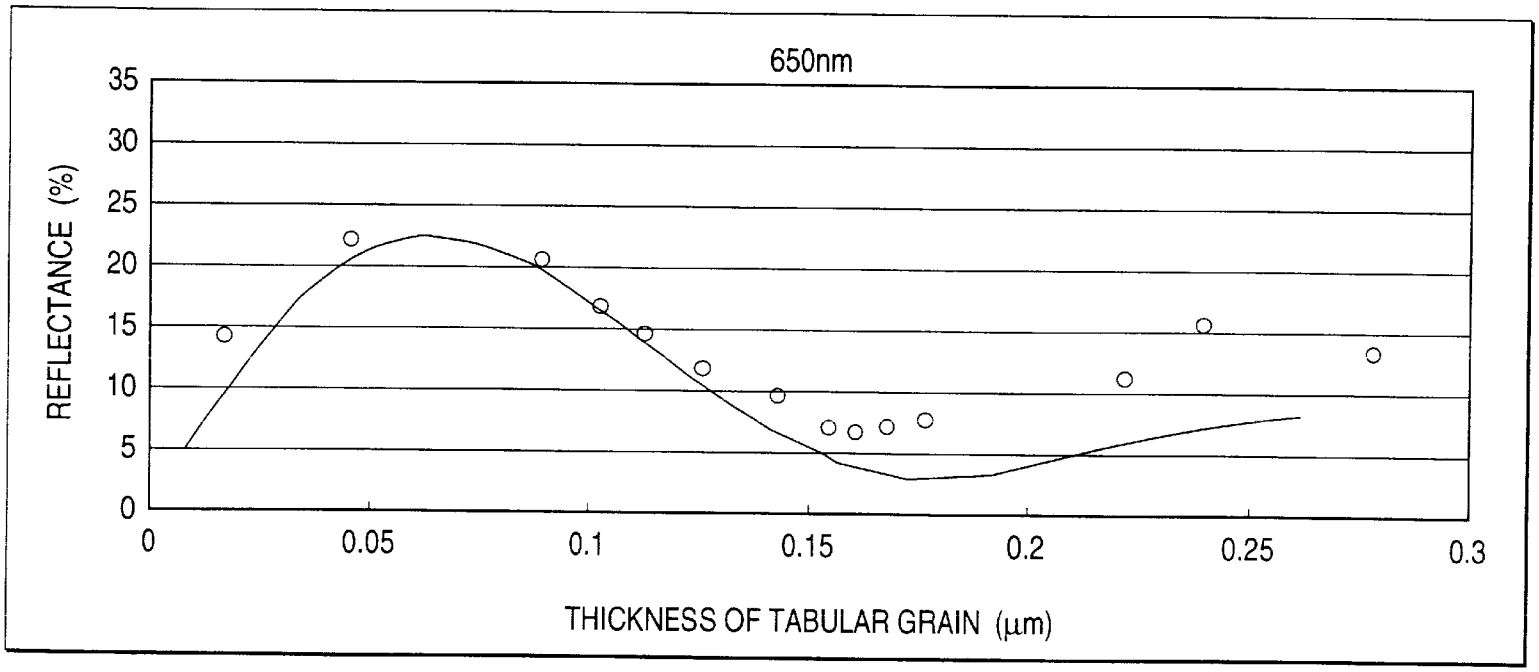
FIG. 9 is a graph showing the relationship between the thickness of a tabular grain and the reflectance of light at an incident light wavelength of 650 nm.

It is possible to calculate the light reflection characteristics of the tabular silver halide grains by means of Mie scattering theory of a spheroid. The calculated values of the reflectance of light obtained when the grain thickness is changed by varying the aspect ratio with maintaining the grain volume constant are shown in FIGS. 7, 8 and 9. The incident light wavelength in FIG. 7 is 450 nm (a blue light), that in FIG. 8 is 550 nm (a green light), and that in FIG. 9 is 650 nm (a red light) The minimum region of the reflectance obtained from this calculation almost coincides with the preferred thickness region in JP-A-6-43605 and JP-A-6-43606. Of the thickness regions giving the minimum reflectance, if the grain thickness further reduces from the smallest thickness region, the reflectance keenly increases, and the reflectance becomes the maximum when the thickness is from 0.034 to 0.042 μm with the blue light of a wave length of 450 nm, from 0.042 to 0.052 μm with the green light of a wavelength of 550 nm, and from 0.06 to 0.07 μm with the red light of a wavelength of 650 nm. Further, the absolute value of the reflectance of this maximum peak is about 2 times or more as high as that of the maximum peak of the thicker region. Using the tabular grains in the above thickness region in a photosensitive layer not only reduces the photographic sensitivity of the photosensitive layer but also when a silver halide emulsion spectrally sensitized with the same wavelength region is present in the layer farther from the light source than the above photosensitive layer, as the light amount which reaches that layer is extremely reduced, the light absorption amount of that layer is largely decreased. On the other hand, the reflected amount of light in the thinner region than the thickness region giving the highest reflected amount of light abruptly decreases.

In this region, it is possible to reduce the reflectance of light with maintaining the aspect ratio of the tabular grain extremely high.

The thickness of the tabular grains which can be used in the present invention is preferably a thickness giving 90% or less of the maximum light reflectance, more preferably 80% or less, and most preferably 70% or less. That is, the grain thickness is preferably about 0.024 μm or less in a blue-sensitive silver halide emulsion layer, about 0.032 μm or less in a green-sensitive silver halide emulsion layer, and about 0.045 μm or less in a red-sensitive silver halide emulsion layer, more preferably about 0.018 μm or less in a blue-sensitive silver halide emulsion layer, about 0.026 μm or less in a green-sensitive silver halide emulsion layer, and about 0.037 μm or less in a red-sensitive silver halide emulsion layer, and most preferably about 0.015 μm or less in a blue-sensitive silver halide emulsion layer, about 0.021 μm or less in a green-sensitive silver halide emulsion layer, and about 0.031 μm or less in a red-sensitive silver halide emulsion layer.

When an emulsion layer containing tabular grains spectrally sensitized to a certain wavelength region comprises two or more layers, it is possible to intentionally increase the spectral reflectance of the layer farther from the light source to reflect light in the layer for the purpose of increasing the light absorption amount of the layer nearer to the light source. The spectral reflectance of the layer farther from the light source is preferably 80% or more of the reflection maximum value, more preferably 90% or more. That is, the grain thickness of the layer farther from the light source is preferably from 0.018 to 0.061 μm in a blue-sensitive silver halide emulsion layer, from 0.026 to 0.068 μm in a green-sensitive silver halide emulsion layer, and from 0.037 to 0.093 μm in a red-sensitive silver halide emulsion layer, and more preferably from 0.024 to 0.054 μm in a blue-sensitive silver halide emulsion layer, from 0.032 to 0.062 μm in a green-sensitive silver halide emulsion layer, and from 0.045 to 0.084 μm or less in a red-sensitive silver halide emulsion layer.

When the equivalent-circle diameter of a tabular grain becomes small, the effect of the equivalent-circle diameter to the reflectance also becomes large. For reducing the reflectance, a tabular grain preferably has an equivalent-circle diameter of 0.2 μm or more, more preferably 0.4 μm or more, and most preferably 0.6 μm or more.

A tabular grain preferably has a thickness of from 0.01 to 0.5 μm, and more preferably from 0.01 to 0.3 μm.

The tabular grains according to the present invention preferably have an average aspect ratio of 2 or more, more preferably from 2 to 500, still more preferably from 8 to 200, and most preferably from 8 to 50.

When monodispersed tabular grains are used, more preferred results can be obtained.

(III) Increase of Refractive Index of Dispersion Medium Layer

A method of increasing the refractive index of a dispersion medium layer for controlling the reflection of light to thereby further improve sensitivity and image quality will be described below.

(III-1) Mixing of High Refractive Index Inorganic Fine Particles

In a color photographic material, 1 or more, preferably from 1 to 20, more preferably from 2 to 10 kinds of, high refractive index inorganic fine particles are contained in one or more AgX emulsion layers of a blue-sensitive layer, a green-sensitive layer, and a red-sensitive layer. The optical density ($cm^{-1}$) to visible light (1) of a dispersion medium layer containing the inorganic fine particles but not containing the photosensitive AgX emulsion grains is preferably from 0 to $10^3$, more preferably from 0 to 100, still more preferably from 0 to 10, and most preferably from 0 to 1.0. Visible lights (1) herein indicate blue, green and red lights with a blue-sensitive layer, green and red lights with a green-sensitive layer, and a red light with a red-sensitive layer. Herein a blue light means a light of a wavelength of from 430 to 500 nm, preferably from 400 to 500 nm, a green light means a light of a wavelength of from 501 to 590 nm, and a red light means from 591 to 670 nm, preferably from 591 to 730 nm. The optical density is a $b_4$ value in equation (a-3) shown below, $I_0$ is the light strength of an incident light, I is the light strength of the transmitted light from the material to be measured, and $x_1$ is the thickness (cm) of the material to be measured.

$$I=I_0\exp(-b_4x_1) \quad \text{(a-3)}$$

The optical density is based on the intrinsic light absorption of the fine particles themselves and light scattering. The light scattering density is preferably small, and the optical density due to solely light scattering is preferably from 0 to $10^3$, more preferably from 0 to $10^2$, still more preferably from 0 to 10, and most preferably from 0 to 1.0. For decreasing the light scattering density, it is preferable to set the equivalent-sphere diameter (a diameter of a sphere having the same volume with the fine particle) of the fine particles at a region not causing Mie scattering, and with the wavelength of light as $\lambda_1$, the region is preferably from $10^{-3}\lambda_1$ to $0.5\lambda_1$, more preferably from $10^{-3}\lambda_1$ to $0.2\lambda_1$, and most preferably from $10^{-3}\lambda_1$ to $0.05\lambda_1$. The equivalent-sphere diameter of the fine particles is in general from $10^{-3}$ to 0.20 $\mu$m, more preferably from $10^{-3}$ to 0.10 $\mu$m, and still more preferably from $10^{-3}$ to 0.04 $\mu$m.

"Substantially transparent" stated in embodiment (I)-(l) means that the fine particles shows the above optical density to the photosensitive peak wavelength light.

The inorganic fine particles are preferably present in the dispersion medium layer in the state of not coalescing among particles. That is, (the total number of coalesced primary fine particles comprising 7 or more, preferably 4 or more, and more preferably 2 or more, in the particles/the total number of primary fine particles)=$A_7$ is from 0 to 0.20, preferably from 0 to 0.05, more preferably from 0.0 to 0.01, and most preferably from 0.0 to 0.001. A coalesced particle (a secondary particle) is formed by contact coalescence of particles, and has a constricted part at the coalesced part. The junction cross-sectional area of a constricted part is from 1 to 85%, preferably from 3 to 70%, and more preferably from 6 to 50%, of the cross-sectional area of the central part of the primary fine particle parallel thereto.

If the inorganic fine particles are eluted to the processing solution during development (including bleaching, fixing and washing processes) and removed from the photographic material such as AgX fine particles, for instance, they should be sufficient to have the above characteristics during photosensitization process. However, when the fine particles are not removed during development processing, they remain in the image of the photographic material. If the fine particles have optical density to a visible light when the image is observed by visible light irradiation, the image quality of a color image is deteriorated. Accordingly, in this case, the optical density to visible light (2) of any of fine particles in a blue-sensitive layer, a green-sensitive layer and a red-sensitive layer is preferably from 0 to $10^3$, more preferably from 0 to $10^2$, still more preferably from 0 to 10, and most preferably from 0 to 1.0. Herein, visible light (2) means a light having a wavelength of from 480 to 600 nm, preferably from 420 to 700 nm, and more preferably from 390 to 750 nm The fine particles may be crystalline, amorphous, or a mixture of them. A crystalline phase and an amorphous phase may be mixed. An electrically conductive solid is generally high in conduction electron density, which absorbs a visible light, therefore, the absorbance to a visible light is high, but a nonconductive solid is low in conduction electron density, therefore, the absorbance to a visible light is low. Accordingly, the latter material, in particular, an insulating material is preferably used. The specific resistance (Ω·cm) at 25° C. is preferably $10^{-2}$ or more, more preferably from 1.0 to $10^{23}$, still more preferably from $10^3$ to $10^{23}$, and most preferably from $10^6$to $10^{23}$.

When the particles mainly comprise $TiO_2$, the surfaces of the particles maybe covered with one or more other metallic oxides which are lower than the particles in $TiO_2$ content by 10 to 100 mol %, preferably from 50 to 100 mol %. As the examples of such metallic oxides, oxides described later in the item (VI-1) can be exemplified, e.g., one or more of the oxides of Al, Si, Zr, Sb, Sn, Zn, and Pb can preferably be used. Specific examples include $SnO_2$, $Al_2O_3$, $SiO_2$, and coprecipitated products of $TiO_2$ with these compounds.

(III-2) Relationship Between Mixing Amount and Refractive Index Value of Fine Particles When a material is a multicomponent comprising various components, the following equation is approximately formed in many cases with taking the specific refraction of the material as r, the wt % of each component as $c_1$%, $c_2$% . . . $c_n$%, the specific refraction of each component as $r_1$, $r_2$ . . . $r_n$. However, when the conditions of the outer-shell electrons of the component atoms are varied due to the interaction among the components, a deviation occurs from the rule of additivity according to the degree of variation.

$$100r=c_1r_1+c_2r_2+\ldots c_nr_n \quad \text{(a-4)}$$

The relationship between the mixing amount and the refractive index of the fine particles can be estimated by equation (a-4). However, specific refraction is (molar refraction $R_0$/molecular weight M), and is in the following relationship with the refractive index of the material $n_3$:

$$(n_3^2-1)/(n_3^2+2)=R_0\cdot n_0/M \quad \text{(a-5)}$$

wherein $n_o$ represents the specific gravity of the material.

(III-3) Measuring Method of Refractive Index of Dispersion Medium Layer

The following methods can be exemplified.

1) Dispersion medium solutions having the same composition except that one contains AgX tabular grains and another does not contain AgX tabular grains are prepared using dispersion medium, water, a material making the refractive index high, an emulsified product of a color forming agent, etc. These solutions are concentrated and dried, and the refractive indices of the dried products are measured.
2) The refractive index can be obtained approximately by utilizing the rule described in the item (III-2) from the compositions of the elements in the dispersion medium layer of a photographic material.
3) A photographic material is cut perpendicularly to the main plane, the micro-reflectance at the part comprising only the dispersion medium layer is measured from the cross section and the refractive index can be obtained from the reflectance.

(IV) Control of Reflectance of Light in Photographic Material (IV-1) The Case in Which Optical Influence of Adsorbed Dye Can be Neglected When the main plane of an AgX tabular grain is subjected to incidence of light, if the refractive index of the dispersion medium layer and the refractive index of the AgX grain are different, reflection of light occurs at the interface of them.

In general, when a light is vertically injected from a medium having a refractive index of $n_4$ to a medium having a refractive index of $n_5$ and light reflection occurs at the interface, the reflection coefficient $R_1$ is represented by equation (a-6) and the reflection strength $R_2$ is represented by equation (a-7).

$$R_1=(n_4-n_5)/(n_4+n_5) \quad \text{(a-6)}$$

$$R_2=(n_4-n_5)^2/(n_4+n_5)^2 \quad \text{(a-7)}$$

Let it be supposed that the dispersion medium of the protective layer and the AgX emulsion layer is gelatin, the refractive index thereof at 475 nm wavelength light is 1.55, and the refractive index of AgBr is 2.34. FIG. 1 shows the refractive index structure of the dispersion medium of the interlayer between the protective layer surface and the main plane of an AgBr tabular grain of a photographic material. (N-1) in FIG. 1 shows a mode of conventional photographic material having an interlayer comprising one dispersion medium layer. (N-2) shows a mode of an interlayer comprising two layers respectively having refractive indices of 1.55 and 2.0. (N-3) to (N-5) each shows a mode in which the number of interlayer is further increased and the difference in grade of the refractive index between each layer is made smaller.

For example, these are modes in which the refractive index of the interlayer is changed in multilayer stepwise manner, i.e., preferably from 2 to 30 layers, more preferably from 3 to 20 layers, and still more preferably from 4 to 20 layers of intermediate refractive index phases are provided, and the refractive index monotonically decreases from the AgX grain surface to the protective layer surface. Multilayer coating of protective layers will suffice for that purpose, for instance. Further, it is more preferred to perform multilayer coating such that the interface of each layer may be mixed a little with each other (from 0.1 to $10^3$ nm, preferably from 0.1 to 100 nm in depth) so as to avoid abrupt discontinuous change of refractive index values between each layer. This mode can be realized by multilayer-coating the layers with liquid coating, adjusting the viscosity of each layer at the time of coating, and making a time adjustment until gelation after coating.

(IV-2) The Case in Which Adsorbed Dye is Taken into Consideration

When a sensitizing dye is adsorbed onto the AgX grain surface, the adsorption amount is in many cases monomolecular layer saturation adsorption amount or less. However much one may devise, the adsorption amount is bimolecular layer or less, and the thickness of the dye-adsorbed layer is 3.0 nm or less in many cases, e.g., 1/200 or less of the wavelength of light of 600 nm. As the adsorbed dye has not yet formed one optical medium layer, the reflection coefficient of light at the AgX grain surface is almost equal to the reflection coefficient at the interface of the dispersion medium layer and the AgX layer. That is, it can be considered to be a reflection coefficient at the interface of the dispersion medium layer where a small amount of a dye is mixed and the AgX layer.

In general, when a light is injected from a low refractive index layer (a dispersion medium layer) to the main plane of a high refractive index layer (AgX tabular grain) and reflection occurs at the interface, since the electric field vector of the incident wave and the electric field vector of the reflected wave are in opposite directions and they cancel each other, the light strength is weakened in the vicinity of the interface. For that reason, there is inefficiency that the light absorption amount of the sensitizing dye adsorbed onto the interface is restrained. The larger the value of (the refractive index of the AgX layer/the refractive index of the dispersion medium layer)=$A_{21}$ becomes in the region of 1.0 or more, the large becomes the inefficiency.

In this case, the inefficiency can be reduced by increasing the refractive index of the dispersion medium layer to make $A_{21}$ approach 1.0, as a result the reflected amount of light is also reduced.

In these cases similarly to the above, it is preferred to reduce the light reflection strength by the continuous reduction of the refractive index of the interlayer (the dispersion medium layer) from the dye layer to the protective layer or by the monotonous reduction with taking the multilayer constitution, i.e., the same mode as the above embodiment.

(IV-3) Control of Refractive Index of Dispersion Medium in Each AgX Layer

In each photosensitive layer of a blue-sensitive layer, a green-sensitive layer, and a red-sensitive layer, the optimal refractive index value of the dispersion medium layer is different due to the presence or absence of the intrinsic light absorption of AgX, a difference in adsorption, a difference in the kind of a sensitizing dye, a difference in the wavelength of a photosensitive light, a difference in the amount of a scattered light component, etc. In general, the farther the layer from the subject, the more is the light component subjected to scattering of the AgX grains in the upper layer, and the incident angle of the light to the support is larger as compared with the incident light to the photographic surface, thereby variation occurs in the reflected light strength. Therefore, strictly speaking, the amount of a scattered light component is different little by little even between each of the first layer . . . the $m_1$th layer in the same photosensitive layer, as a result the optimal refractive index value of the dispersion medium layer is different even between each of the first layer . . . the $m_1$th layer.

It is preferred that the refractive index value in each photosensitive layer, further, in each dispersion medium of the first layer . . . the $m_1$th layer in each photosensitive layer be set optimally. When the optimal refractive index value is different between the adjacent photosensitive layers ($n_{18}$ and $n_{19}$), it is preferred to inhibit the abrupt change in refractive index by setting the refractive index value $n_{20}$ of the interlayer between them at ($n_{18}<n_{20}<n_{19}$). Further, as described above, the interlayer may take the structure of multilayer constitution comprising two or more layers, and the above description can be referred to.

(IV-4) Grain Structure of Tabular Grains

The refractive indices of AgX grains of NaCl type crystal structures are AgCl<AgClBr<AgBr<AgBrI in order of magnitude. Consequently, the use of AgX grains having a smaller refractive index will suffice for controlling the reflected amount of light. Therefore, the preferred order of AgX compositions from the point of controlling the reflected amount of light is AgCl>AgClBr>AgBr>AgBrI.

However, there is a case in which the use of AgBrI cannot be helped in view of photographic characteristics. In such a case, it is preferred to form a shell layer of one or more of AgCl, AgClBr and AgBr on the AgBrI grains. The reflected amount of light decreases with the increment of the thickness of the shell layer, and when the shell thickness reaches the thickness corresponding to wavelength of 0.6 or more, the AgBrI core layer comes to have almost no effect. However, thickening of the shell layer to that level results in lowering of the aspect ratio of the tabular grains, hence it is preferred to select the optimal shell thickness within the range of from 0.01 to 0.25 $\mu$m.

In general, preferred tabular grains are core/shell type tabular grains having a shell AgX layer having a thickness of from 0.01 to 0.25 μm at least on the main planes of core tabular AgX grains in which the refractive index of the core AgX layer is higher than the refractive index of the shell AgX layer by 0.05 to 0.30, preferably from 0.10 to 0.20.

(IV-5) Measurement of Reflectance of Tabular Grain

The reflected light strength of a tabular grain is obtained as follows. A tabular grain is set so that the main plane becomes parallel to the support surface, and 1) the tabular grain is subjected to exposure at the incident angle of 5° with a beam of light, the reflected light strength is measured in the direction of the reflection angle of 5°. The beam of light is preferably passed through a pinhole capable of passing a light provided on a light-shielding plate. The light which passes through the central part of the pinhole goes straight on and the light which passes the vicinities of the central part diffracts. Therefore, the beam of light comprises the part of going straight on and the part of the diffracted light which broadens and comes to have interference fringes with the progress of light. When the diffraction angle to the primary bright line of the interference fringes is taken as θ, $$\text{Sin}\theta = \text{about } \lambda_1/d_{11} \quad \text{(a-10)}$$

wherein $d_{11}$ is the diameter of the pinhole. Therefore, when $d_{11}$ becomes small to the degree of the wavelength, θ becomes large. However, as the light strength of the primary bright line is about 4.7% of the light strength at the central part, measurement can also be performed without considering this fact.

For applying the beam of light to only one tabular grain, it is suitable to make the tabular grain diameter large or make the beam diameter small, but the method of the latter is restricted as described above. Accordingly, it is preferred to make the tabular grain diameter large. The diameter of the tabular grain is preferably from 0.50 to 30 μm, more preferably from 0.80 to 10 μm. A natural light and a laser beam, a monochromatic light and a polychromatic light can be used. A laser beam having less phase difference is preferred to a natural light because the coherent length is longer hence more coherent.

2) A lens is set between the pinhole and the tabular grain so that the pinhole image is formed on the tabular grain, thereby the irradiation of a fine beam of light on the tabular grain becomes possible. This is because the diffracted light also converges again as a pinhole image.
3) A light-shielding plate with a pinhole is set contiguously to a tabular grain, irradiation with a light is performed at an incident angle of 5°, the light is received at an reflection angle of 5° and the reflected light strength is measured.
4) A light-shielding plate with a pinhole is set in the optical path of the reflected light with the irradiation light as a thick beam of light of ($d_{11} >> \lambda_1$).

A reflected light can be detected by placing a light amount detector directly at a light-receiving part, or can be detected with a detector after passing a light through an optical fiber. With respect to the optical fiber, the light amount detector, the light source, the measuring method of a reflected light, JP-A-9-61338 can be referred to.

The reflectance can be obtained by (reflected light strength/incident light strength), and incident light strength can be obtained by measuring directly an incident light with a light amount detector.

(V) Producing Method of Inorganic fine Particles Having High Refractive Index (V-1) Pulverizing Method When the diameters of particles obtained from natural ores and artificial synthetics are larger than an intended diameter, they are pulverized to make finer particles. As synthetics are synthesized by removing impurities from ores, high purity products can be obtained and more preferably used.

As the pulverizing method, a dry process of performing pulverization in a dry state and a wet process of performing pulverization after mixing the particles with a solution can be exemplified, and a wet process is more preferably used.

The inorganic fine particles are preferably pulverized in an aqueous solution containing from 0.01 to 10 wt %, preferably from 0.1 to 5.0 wt %, of a water-soluble dispersion medium (containing one or more of a water-soluble polymer, a surfactant, a photographic antifoggant, an onium base-containing compound, a phosphoric acid, a silicic acid, and an organic acid), and the pulverized size of the inorganic fine particles is from $10^{-8}$ to 0.5 times, preferably from $10^{-8}$ to 0.1 times, of the original average volume.

Further, the inorganic fine particles are formed through a hydrolysis reaction of a metal ester (a metal alkoxide, an ester of a metallic base with an acid) and the subsequent condensation reaction, and preferably at least the condensation reaction is performed in an aqueous solution containing from 0.05 to 7 wt % of a water-soluble dispersion medium (containing one or more of a water-soluble polymer, a surfactant, a photographic antifoggant, a phosphoric acid, a silicic acid, and an organic acid).

Further, it is preferred to include a desalting process during the time of from the termination of the condensation reaction to immediately before incorporation into a photographic material for the purpose of reducing the alcohol, the acid or the base which is present in the dispersion medium solution to 0 to 5%.

The pulverization means to make the average size of the particles three dimensionally coalesced to $10^{-8}$ to 0.5 times, preferably from $10^{-8}$ to 0.1 times, of the original volume. "Original" used herein means the coalesced particles before being pulverized in the aqueous solution.

(V-2) Method for Forming Particles in Solution (V-2-1) Method for Forming Sparingly Soluble Salt by Adding Constitutional ion to Aqueous Solution In the case of AgX grains, the fine particles can be formed by adding $Ag^+$ and $X^-$ with stirring to an aqueous solution containing a water-soluble dispersion medium.

(V-2-2) Formation of Fine Particles of Oxide by Hydrolysis of Alkoxide

Water is added to a metal alkoxide solution to perform hydrolysis to thereby form a metallic hydroxide, the obtained metallic hydroxide is condensed and dehydrated, as a result, particles of a metallic oxide are obtained.

(V-2-3) Other Hydrolyzing Methods

Water is added to a titanium sulfate which is ester bonded with a sulfuric acid, titanyl sulfate, and a titanium tetrachloride which seems to be ester bonded with a hydrochloric acid, the mixture is hydrolyzed to thereby synthesize a water-containing titanium oxide. The obtained product is dehydrated and condensed to reduce the number of $m_{21}$ of $TiO_2.m_{21}H_2O$. Heating is preferred for accelerating the condensation.

In general, when anatase type particles are heated at 800° C. or higher, from 90 to 100% of the particles are changed to a rutile type. When heated at 500 to 800° C., a part of them (from 1 to 99 mol %) is changed to a rutile type.

The method of forming a metallic oxide by the hydrolyzing method can be used as the method for forming oxides of all the metallic element preferably excluding elements of atomic numbers of 43 to 47, 75 to 79, 84 to 89, and 93 to 103.

A water-soluble salt may be coexistent during the hydrolysis reaction and the condensation reaction in concentration of from 1.0 to $10^{-8}$ mol/liter, preferably from $10^{-1}$ to $10^{-7}$ mol/liter.

(V-3) Preparation of Multistructural Fine Particles

After $TiO_2$ fine particles are formed, a metallic oxide other than $TiO_2$ is laminated on the surface of the $TiO_2$ fine particles. An aqueous solution containing a salt such as Al, Si, Ti, Zr, Sb, Sn, or Zn and an acid or an alkali to neutralize them are added to the aqueous solution containing $TiO_2$ fine particles, and the surfaces of the particles are covered with the obtained water-containing oxide. The by-produced water-soluble salts can be removed by the desalting method described later.

In addition, a coprecipitation method can be utilized. For example, a titanium oxide is coprecipitated with a silica and an alumina to prepare a composite oxide of the state comprising a matrix of a silica and an alumina having dispersed therein a titanium oxide. For example, a method of mixing $TiCl_4$ with Si $OC_2H_5)_4$ and $AlCl_3$ in a predetermined proportion, hydrolyzing, coprecipitating, and calcining, and a method of coprecipitating the mixture of alkoxide of Si, Ti, Al by hydrolysis, and calcining can be utilized. Calcining can be performed after washing with water. It is preferred to use the obtained composite oxide after pulverization.

(VI) Examples of Fine Particles Having High Refractive Index

The following substances can be exemplified as the examples of inorganic fine particles.

(VI-1) Oxide

Ia to VIb group elements of 2 to 7 period in the long period type of the Periodic Table of elements, preferably the oxides of IIIa to IVb group elements. Oxides of a single element, oxides containing two or more elements, and mixtures of two or more of these-oxides may be used. Particularly preferred oxides are oxides containing as a main component at least one of Ti, Sn, Zn, Al, Pb, Ba, In, Si, Sb, As, Ge, Te, La, Zr, W, Ta, Th, and Nb, and oxides containing at least one of Ti, Sn, Zn, Al, or Si as a main component are more preferred. Here, "main component" means that (total number of atoms of the main component/total number of atoms except for oxygen and hydrogen atoms)=$A_{33}$ is the largest in the substance, preferably $A_{33}$ is from 0.60 to 1.0, more preferably from 0.80 to 1.0.

These oxides will be explained below with specific examples.

(VI-1-1) Oxide Containing Ti as a Main Component

An oxide containing Ti as a main component in the definition $A_{33}$, wherein the composition of the oxide of $A_{33}$ =from 0.95 to 1.0, preferably from 0.98 to 1.0, is expressed as ($TiO_2.mH_2O$) for convenience, wherein m is from 0 to 3.0, preferably from 0.05 to 2.0.

As the particle structures, amorphous, crystalline, and mixtures of these can be exemplified. As the crystal structures, a rutile type, an anatase type, and a brookite type can be exemplified. The optimal type or optimal mixtures thereof can be selected according to the purpose. The refractive index value of anatase type crystals shows less dependency on crystal axis and the refractive index value is uniform in every direction of the crystal. Accordingly, anatase type crystals are advantageous in view of capable of controlling uniform refractive index value of the dispersion medium layer.

On the other hand, the refractive index value to visible lights (1) and (2) of rutile type crystals is higher than that of anatase type crystals, therefore, rutile type crystals are advantageous in that the refractive index value of the dispersion medium layer can be made higher with the same addition amount of fine particles. However, rutile type crystals show high dependency on crystal axis of the refractive index value, have intrinsic absorption nearer to 410 nm, and has a drawback of absorbing a part of a blue light.

In amorphous body, crystal lattice is already lost hence it is advantageous that particles are easily atomized by pulverization, but refractive index values to 550 nm wavelength light are approximately [rutile type (2.65, 2,95)> anatase type (2.59, 2.51)> amorphous type (=about 2.1)], hence it is disadvantageous that the refractive index value is the smallest. Here, (2.65, 2.95) indicates that the refractive index to the light perpendicular to the crystal axis is 2.65 and the refractive index to the light parallel to the crystal axis is 2.95.

Artificial synthetics of titanium oxide (a rutile type and an anatase type) are industrially primarily produced by a sulfuric acid method or a chlorine method. Water-containing titanium oxides are in many cases synthesized by a hydrolysis reaction of a titanium sulfate solution, a titanium chloride solution, or a titanium alkoxide solution.

(VI-1-2) Double Oxide

Oxides in which two or more metals are coexistent are generally called double oxides.

As the examples of double oxides, a spinel type oxide (e.g., $MgAl_2O_4$), an ilmenite, perovskite type structure, the case in which the metals of the same kind coexist in two or more oxidation numbers (e.g., $Fe^{II}Fe^{III}{}_2O_4$, $Pb^{IV}Pb^{II}{}_2O_4$), (in $MTiO_3$, M is Mn, Fe, Co, Ni, Cd, Mg, Ca, Sr, Ba or Pb), (in $MNbO_3$, M is Li, Na or K), (in $MZrO_3$, M is Ca, Sr, Ba, Cd or Pb) can be exemplified. Preferred examples include titanate zirconates (e.g., those whose partner ion is $Pb^{II}$), strontium titanate, lead titantate, and barium titanate.

(VI-1-3) Glass

Inorganic substances capable of becoming vitreous are as follows: chalcogen element substances such as selenium and sulfur; oxides and oxide salts of silicon, boron, phosphorus, and germanium; and chalcogenide based glass of sulfide or a selenium compound.

Main examples include silica glass, borosilicate glass, lead glass, aluminosilicate glass, and phosphate glass.

(VI-1-4) Other Oxides

A zinc oxide and a lead white can be exemplified.

(VI-2) Inorganic Sparingly Soluble Salts

For example, silver halides (e.g., AgCl, AgBr, AgI, and mixed crystals of two or more of these within the limit of solid solubility) can be exemplified. The refractive index values of the AgX grains having NaCl type crystal structure are in order of (AgCl<AgClBr<AgBr<AgBrI). Therefore, AgBrI is preferably used for increasing the refractive index value of a dispersion medium layer with the same addition molar amount.

Figure 3:
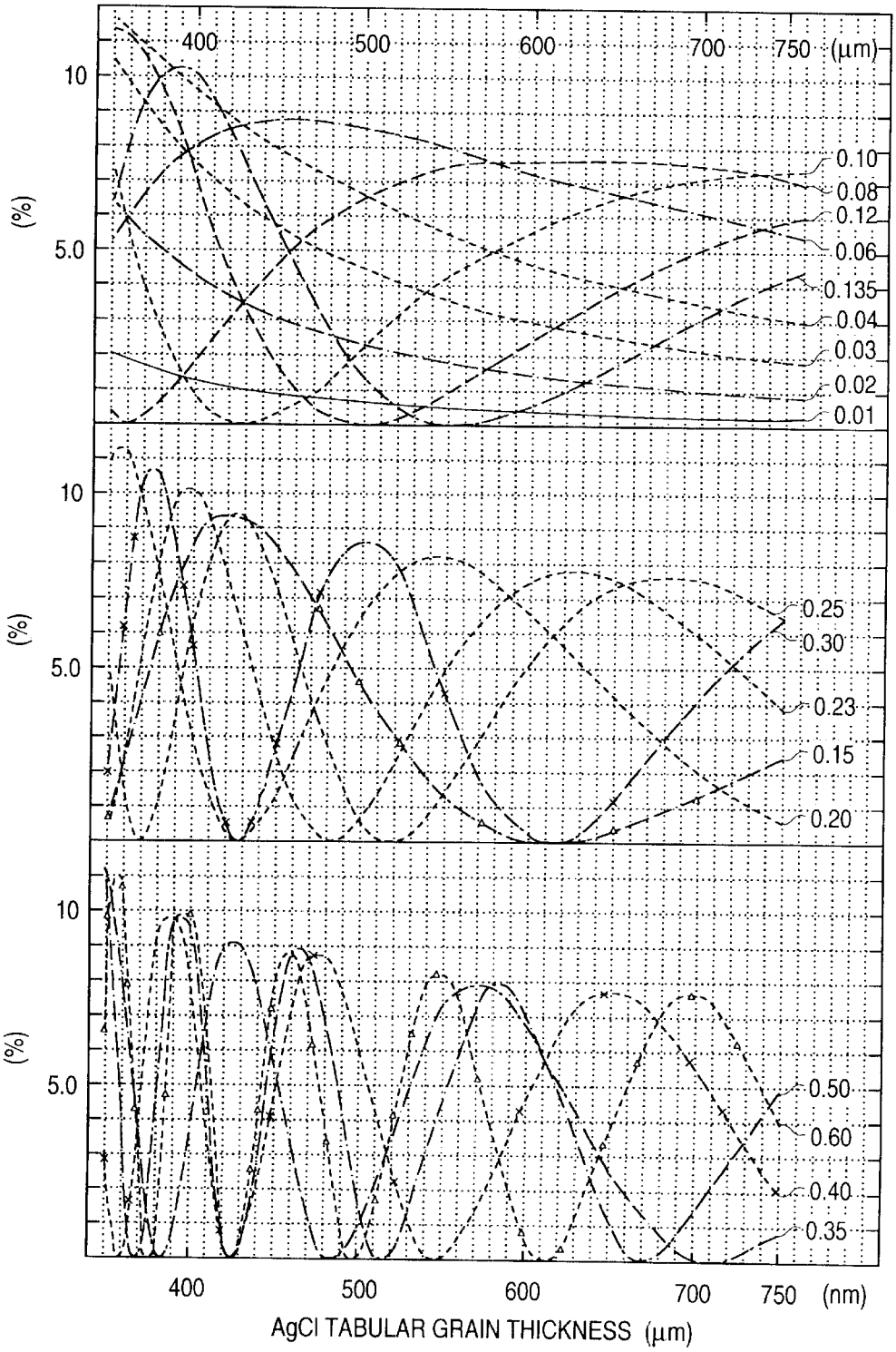
FIG. 3 shows the wavelength dependency and the thickness dependency of the reflectance of light (%) on the large size AgCl tabular grain in a gelatin phase.
Figure 4:
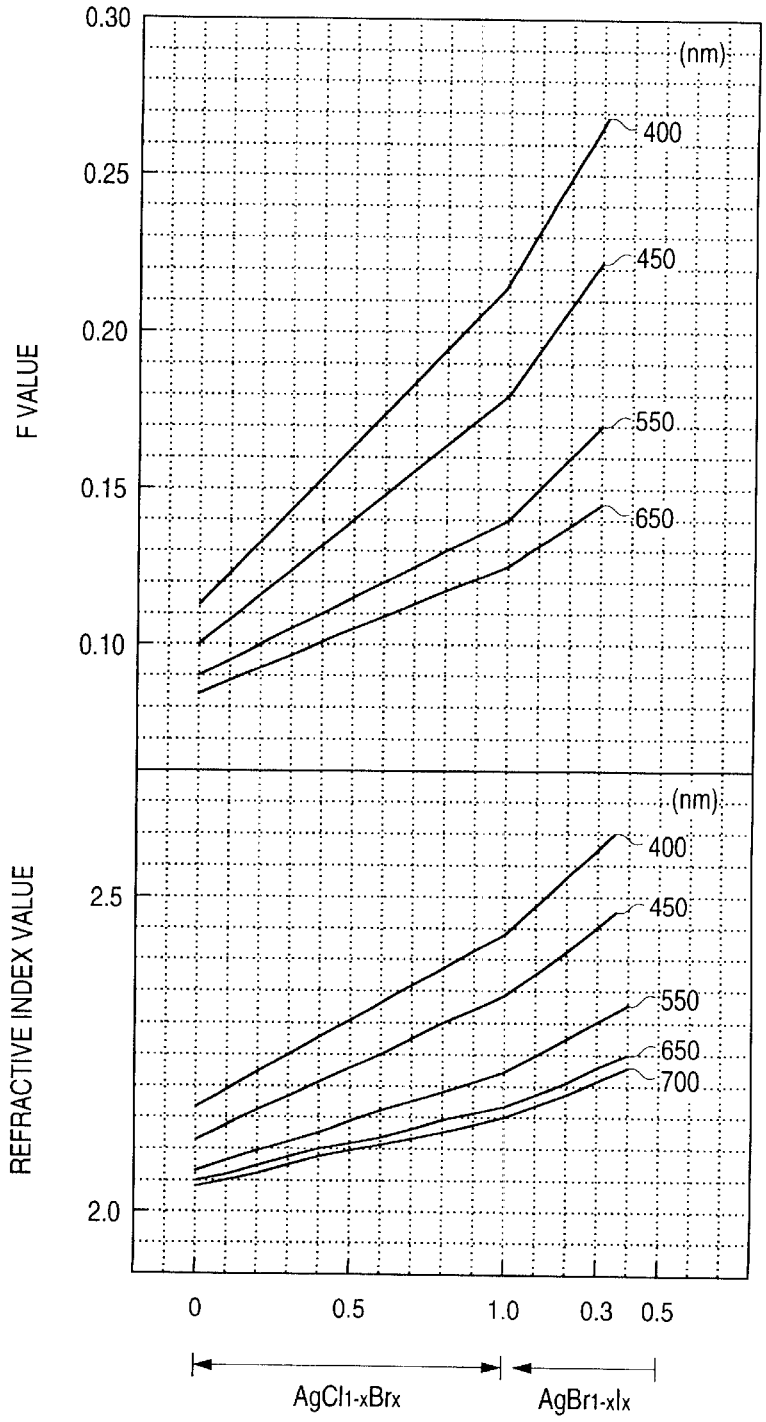
FIG. 4 shows the relationship between an AgX composition and the refractive index value and the F value thereof.
Figure 5:
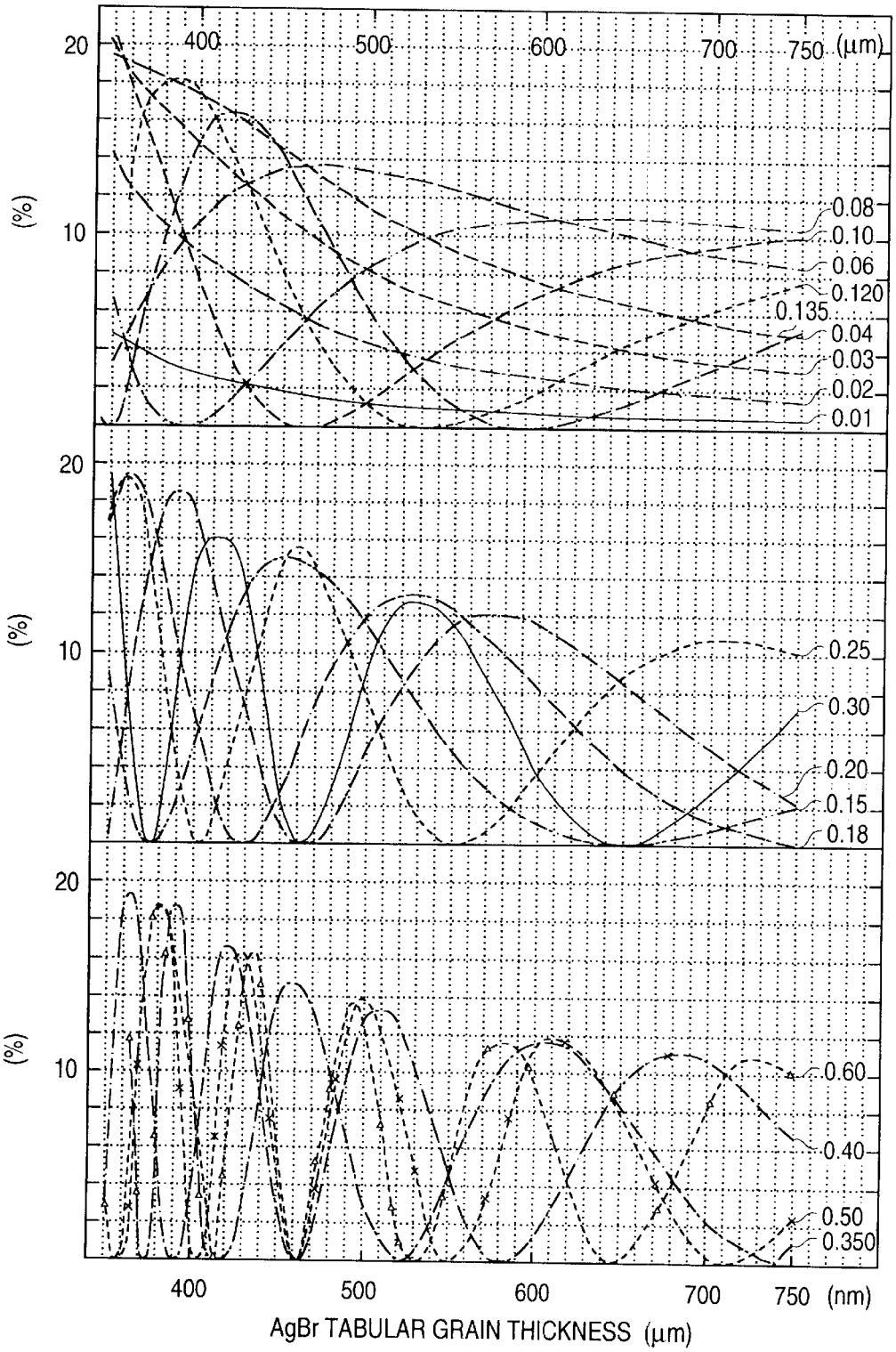
FIG. 5 shows the wavelength dependency and the thickness dependency of the reflectance of light (%) on the large size AgBr tabular grain in a gelatin phase.

(VII) Light Coherency of AgX Tabular Grains and Usage Thereof (VII-1) Light Coherency of AgX Tabular Grains An equation for calculation of reflection interference to a parallel tabular grains is described in Chapter 7 of Literature 3below. The refractive indices of gelatin, AgCl, AgBr, AgI in the visible light region is described in Chapter 20 of Literature 1, and Literature 2. Using these methods, light interference characteristics at the time when the main plane of a tabular grain is subjected to vertical incidence of light are shown in FIGS. 3 to 5, taking a big AgX tabular grain in a gelatin dispersion medium layer as an example. In the embodiment of the present invention, the refractive index of AgX grains ($n_{10}=n_{11}-in_{12}$) is ($n_{11}>>n_{12}$) at 370 to 800 nm, hence $n_{12}$ was neglected in calculation.

The calculated value showed the value of the case of incident angle being 0° due to the simplification of calculation, but coincided with the results of calculation with the incident angle as 5° within the error of 1.0%. The optical path length is 1.0017 times as small as the tabular thickness $d_{11}$ according to the rule of refraction.

FIG. 2 shows the interference relationship of a primary reflected light wave $r^1$ and a secondary reflected light wave $r^2$ to the tabular grain in the electric field. FIG. 2(*a*) shows the mode wherein the difference in the optical path lengths of the optical path length $r^1$ and $r^2$ is 0 or integral number times of the wavelength, and FIG. 2(*b*) shows the mode wherein the difference is odd number times of (wavelength/2). When the thickness is almost zero, the electric field vector of $r^1$ is reversed to that of the incident wave as shown in FIG. 2(*a*), therefore, both waves ($r^1$ and $r^2$) weaken each other. On the other hand, transmitted lights ($t^1$ and $t^2$) are the same in the phase of the wave, hence they strengthen each other. As a result, the reflected light strength decreases and transmitted light strength increases. The same relationship holds in the case wherein the difference in the optical path lengths of $r^1$ and $r^2$ is integral number times of the wavelength.

On the other hand, as shown in FIG. 2(*b*), when the difference in the optical path lengths of $r^1$ and $r^2$ is one half of the wavelength or odd number times of one half of the wavelength, $r^1$ and $r^2$ are the same in the phase of the wave, hence they strengthen each other, and the electric field vectors of $t^1$ and $t^2$ are reversed, therefore, both waves weaken each other. As a result, the reflected light strength increases and transmitted light strength decreases.

FIG. 3 shows the wavelength dependency and the thickness dependency of the reflectance of light (%) on the large size AgCl tabular grain in a gelatin phase. The calculation is performed according to Airy equation in Chapter 7, Literature 3. Concerning this relationship of tabular grains having other AgX compositions, when the refractive index thereof is taken as $b_{11}$ times of AgCl, it is sufficient to multiply the value of the wavelength in FIG. 3 with $b_{11}$. If the next F value is $b_{12}$ times of the F value of AgCl, it is sufficient if only the value of the ordinate in FIG. 3 is multiplied with $b_{12}$. F values of various AgX grains can be read out from FIG. 7. F value increases with the increase of $n_{11}$ value, and the reflectance increases. Therefore, the magnitudes of the refractive indices are in the order of AgCl<AgClBr<AgBr<AgBrI.

$$F=|4R_1|/(1-R_1)^2 \quad \text{(a-17)}$$

When an AgCl tabular thickness is 0.04 μm or less, in the longer wavelength region than 380 nm, (reflected light strength/incident light strength)=$A_{41}$ monotonically decreases with the increase of wavelength. This shows the state of approaching from the condition of FIG. 2(*b*) to the condition of FIG. 2(*a*), and in this thickness region, $A_{41}$ decreases with the reduction of the thickness. Magnitudes of $A_{41}$ value of tabular grains to each light in this thickness region are in the order of a blue light> a green light> a red light.

Generally stating, tabular grains which have a characteristic that $A_{41}$ value monotonically decreases by the wavelength of 400 nm or more, preferably 380 nm or more, can be preferably used as the tabular grains according to the present invention.

For $A_{41}$ value to satisfy (a-1) equation as to all of a blue light, a green light and a red light, it is preferred to use the mode close to FIG. 2(*a*) to these light (tabular grains having the difference in the optical path lengths of $r^1$ and $r^2$ of from 0.01 to 0.3 wavelength, preferably from 0.01 to 0.2 wavelength). Further, for $A_{41}$ value to satisfy equation (a-2) to a blue light and equation (a-1) to a green light and a red light, tabular grains having the most preferred thickness can be selected from the modes in FIG. 2, wherein the difference in the optical path lengths of $r^1$ and $r^2$ of from 0.25 to 0.60 wavelength, preferably from 0.35 to 0.55 wavelength to a blue light, and from 0.05 to 0.30 wavelength, preferably from 0.10 to 0.20 wavelength to a green light and a red light. For example, in the case of FIG. 3, the most preferred tabular grains can be selected from the tabular grains having a thickness of from 0.01 to 0.05 μm, preferably from 0.01 to 0.04 μm.

If the thickness increases, the first peak of $A_{41}$ shifts to longer wavelength region than 400 nm corresponding to the state of FIG. 2(*b*). If the thickness further increases, the second peak shifts, if still further increases, the third peak, and the fourth peak shifts to longer wavelength region than 400 nm, and at last many peaks occur in the visible light region, as a result, $A_{41}$ value abruptly changes to the wavelength fluctuation.

For satisfying equation (a-1) to a blue light, a green light and a red light, it is preferred to use tabular grains having the first minimum wavelength of from 480 to 550 nm, preferably from 500 to 530 nm. Here, "the first minimum wavelength" means the mode in FIG. 2(*a*) wherein the difference in the optical path lengths of $r^1$ and $r^2$ is the wavelength difference of 1.0. In this wavelength region, $A_{41}$ value shows a low value extending the broadest wavelength range.

For satisfying equation (a-1) to a green light and a red light and satisfying equation (a-2) to a green light and a red light, it is preferred to use tabular grains having the first minimum wavelength of from 530 to 660 nm, preferably from 540 to 640 nm, and more preferably from 560 to 610 nm.

As tabular grains which satisfy equation (a-2) to a red light, tabular grains having the first minimum wavelength of from 200 to 500 nm, preferably from 210 to 480 nm are preferably used.

As tabular grains which satisfy equation (a-2) to a green light and satisfy equation (a-1) to a red light, tabular grains having the second peak wavelength light of from 440 to 550 nm, preferably from 460 to 530 nm are preferably used. As tabular grains which satisfy equation (a-2) to a red light and satisfy equation (a-1) to a green light, tabular grains having the second peak wavelength light of from 610 to 770 nm, preferably from 630 to 750 nm are preferably used, and more preferably from 650 to 730 nm. Here, "the second peak wavelength light" means the light showing the difference in the optical path lengths of $r^1$ and $r^2$ of 1.5 wavelength difference in FIG. 2.

In FIG. 3, the reason that the refractive index of the tabular grains having a thickness of 0.040 μm decreases with the increase of wavelength is because the refractive index of AgX decreases with the increase of wavelength, as a result $R_2$ in equation (a-7) decreases.

FIG. 4 shows the relationship between an AgX composition and the refractive index value and the F value thereof to various monochromatic lights. The abscissa indicates the x value of AgX composition, and $AgCl_{1-x}Br_x$ is expressed as $AgCl_{0.5}Br_{0.5}$ with x being 0.5. The numeric values on the right of FIG. 4 are wavelengths of monochromatic lights.

FIG. 5 shows the wavelength dependency and the thickness dependency of the reflected light strength on the large size AgBr tabular grain in a gelatin phase as calculated in the same manner as in FIG. 3. The transmitted light amount ($T_1$%) of the series in FIGS. 3 and 5 is represented by:

$$100=T_1+R_4+Ab \quad \text{(a-18)}$$

wherein the incident light amount is 100, the reflected light amount is $R_4$ (%), and the absorbed light amount is Ab (%). When Ab is 0, $T_1+R_4=100$.

$R_4$ values in FIGS. 3 and 5 are $R_4$ values when the light absorption of AgX is neglected, and $T_1$ value at this time can be calculated by ($T_1=100-R_4$).

In the mode of FIG. 2(*a*), the weakening of the incident light and $r^1$ light on the upper surface of the tabular grain can be inhibited due to the attribution of $r^2$, and $t^1$ and $t^2$strengthen each other, which heightens the light absorbing property of the adsorbed sensitizing dye. Moreover, as $t^1$ and $t^2$ enter the subsequent grain in the mode of strengthening each other, the light absorption of this grain also advantageously increases. On the other hand, in the mode of FIG. 2(*b*), the weakening of the incident light and $r^1$ light on the upper surface of the tabular grain further increases due to the attribution of $r^2$, and $t^1$ and $t^2$ weaken each other, which reduces the light absorbing property of the adsorbed sensitizing dye. Moreover, as $t^1$ and $t^2$ enter the subsequent grain in the mode of weakening each other, the light absorption of this grain also disadvantageously decreases.

In FIGS. 3 and 5, the weakening each other of the incident wave and the reflected wave on the front surface of the tabular grain becomes 0 at the place where $R_4$ is 0%, and the light strength on the front surface becomes equal to the incident light strength. On the other hand, $t^1$ and $t^2$ strengthen each other on the rear surface of the grain, and the light strength on the rear surface becomes equal to the incident light strength from $T_1=100-R_4=100$. Therefore, the total light strength received by the sensitizing dyes on both surfaces is $2I_0$ with the incident light strength as $I_0$.

On the other hand, when $R_4$ value in FIGS. 3 and 5 is the maximum (e.g., in FIG. 5, when the thickness is 0.250 $\mu$m and the light wavelength is 460 nm, $R_4=15.2\%$), the light strength on the front surface of the tabular grain is $[1.0-(0.152)^{0.5}]^2=(1-0.39)^2=0.372$. On the other hand, as the light strength on the rear surface is 1.0–0.152=0848, the total light strength is $1.22I_0$. Accordingly, the light absorption amount of the sensitizing dyes is (the case of the former/the case of the latter)=1.639.

However, this is the result of the case in which the AgX grain and the sensitizing dye hardly absorb a light. Really, at least-a sensitizing dye absorbs a light, and $r^1$ to $r^{20}$ and $t^1$ to $t^{20}$ are reduced, hence the ratio becomes smaller.

The numeric values on the right of FIGS. 3 and 5 are the thicknesses of tabular grains. The larger the tabular grain diameter, i.e., from0.5 to 100 $\mu$m, preferably from 2.0 to 100 $\mu$m, the higher is the accuracy of coincidence with the measured value. (VII-2) Optical characteristics of tabular grains onto which sensitizing dye is adsorbed The reflected light of the tabular grain at the time when the dye adsorption amount is from 0.0 to 100%, preferably from 5.0 to 100%, of the saturated adsorption amount is reflection according to a rule of reflection, and the directivity of reflection is high as compared with the reflection by Rayleigh scattering and Mie scattering. Therefore, the sharpness deterioration due to the reflected light is small and preferably used for the reflective layer.

When tabular grains are used as light reflective plates, the silver coating amount of the tabular grain emulsion and the ratio of silver amount/dispersion medium amount should be optimal amounts. If the silver amount is too small, the reflection effect decreases, while when it is too much, the average number of tabular grains with which one beam of light collides increases. The probability of causing multipath reflection among the tabular grains increases at this time, and the light also scatters in the direction parallel to the support, which reduces the sharpness of an-image. Accordingly, the number of the tabular grains is preferably from 1 to 10, more preferably from 1 to 5, and still more preferably 1 or 2.

It is particularly preferred to use the tabular grains onto which the sensitizing dye is adsorbed as light reflective plates by utilizing the high light reflecting characteristic of the sensitizing dye-adsorbed layer. As this phenomenon does not depend upon the thickness of the tabular grains, the thickness of the tabular grains can be arbitrarily selected. The thickness of the tabular grains in the blue-sensitive layer is preferred to follow the prescription in the above (7) in item (I) and that in the green-sensitive layer is preferred to follow the prescription in (11) in (I). The light to be transmitted to the subsequent layer is advantageously prevented from light scattering due to the tabular grain.

For further increasing the light reflection effect in combination with the light coherency of the tabular grains, it is preferred to use the tabular grains having the thickness defined in (18) in the above item (I). It is more preferred to use the tabular grains which also satisfy the above thickness prescription. The light strength is large to a blue light and small to a green light and a red light in a blue-sensitive layer. The light strength is large to a green light and small to a red light in a green-sensitive layer. The light strength is large to a red light in a red-sensitive layer. Here, "large" means the prescription in the above (a-2) and "small" means the prescription in the above (a-1).

(A-1) When the Reflective Tabular Grains are Used in the Lowermost Layer

When the reflective tabular grains are used in the lowermost layer, the light absorption amount of the AgX grains contained in the layer of a rank ahead of one mainly increases, color image density is increased, thereby a color image having higher Dmax can be obtained.

On the other hand, for the reflective tabular grains to perform a role of mirror to effectively reflect the light, the larger the diameter, the more preferred. If the tabular grains are low sensitivity and substantially do not contribute to the color image formation, the largeness of the grains hardly affects the image quality. In this case, it is preferred for the average diameter of the tabular grains to follow the prescription in (16) in item (I). The diameter is preferably from 0.5 to 30 $\mu$m, more preferably from 1.0 to 30 $\mu$m, and still more preferably from 1.5 to 30 $\mu$m. When the addition amount of a chemical sensitizer to the tabular grains is reduced to 0 to 60%, preferably from 0 to 10%, and more preferably from 0 to 1%, of the optimal amount, the tabular grains become low sensitivity. Further, it is preferred that the tabular grains substantially do not contain dislocation lines, and the number of dislocation line per one grain is from 0 to 4, preferably from 0 or 1, and more preferably 0. This condition is preferred for preparing the following thin tabular grains. The thickness of the tabular grain is more preferably from 0.01 to 0.10 $\mu$m, and still more preferably from 0.01 to 0.06 $\mu$m.

(A-2) When the Reflective Tabular Grains are Used in the second Layer

When the reflective tabular grains are used in the second layer, the light absorption amount of the AgX grains contained in the first layer increases, as a result, the sensitivity of the first layer increases. However, the light amount transmitted to the third layer and lower layers decreases, and the light absorption amount of the third layer and lower layers decreases. The reduced amount=(the reflected light amount+the light amount absorbed by the reflective tabular grains), and the more the reflective tabular grains, the more is the reduction amount. As a result, the sensitivity of the third layer and lower layers decreases, and the color image density also lowers. The following methods can be exemplified for controlling this drawback.

1) The reflective tabular grains are sensitized and contribute to the color image formation, wherein when the color image unites the role of low sensitivity layers of the third layer and lower layers, the sensitivity of the reflective tabular grains (E1) is preferably lower than the sensitivity of the first layer (E2) by 0.05 to 3.0, preferably by 0.10 to 3.0, and more preferably by 0.30 to 3.0.
2) The granularity of the color image must be a proper value.

The granularity is in general proportional to the volume of the photosensitive AgX grain. Therefore, it is necessary to make the volume of the grain small for obtaining good granularity. On the other hand, for the purpose of obtaining high reflectance the diameter is preferably large. Accordingly, it is preferred to make the diameter large within the range not to deteriorate the granularity of the photograph at large.

In general, the larger the thickness of the tabular grain, the worse the granularity. Therefore, it is preferred to make the thickness of the tabular grain thin for the purpose of not deteriorating the granularity. On the other hand, as the thickness dependency of the light reflectance based on the dye-adsorbed layer is small (if the tabular grain is thin, the reflectance reduces a little, however), this relationship can be preferably utilized. The thickness of the tabular grain is more preferably from 0.01 to 0.10 $\mu$m, and still more preferably from 0.01 to 0.06 $\mu$m. However, a problem concerning granularity arises at a low density part of a photograph. Dye clouds overlap each other at a high density part hence the granularity goes out of sight. Hence, the granularity of the second layer is permitted to be worse than that of the first layer. Therefore, the average volume of the tabular grains in the second layer is preferably from 0.60 to 4.0, more preferably from 1.0 to 4.0, and still more preferably from 1.10 to 4.0, of the average volume of the tabular grains in the first layer.

In any case, the value of (the dye adsorption amount of the tabular grain/the saturated adsorption amount) is preferably larger than that of the layer of a rank ahead of one by 0.05 or more, preferably by 0.10 or more, and more preferably by 0.16 or more.

Figure 6:
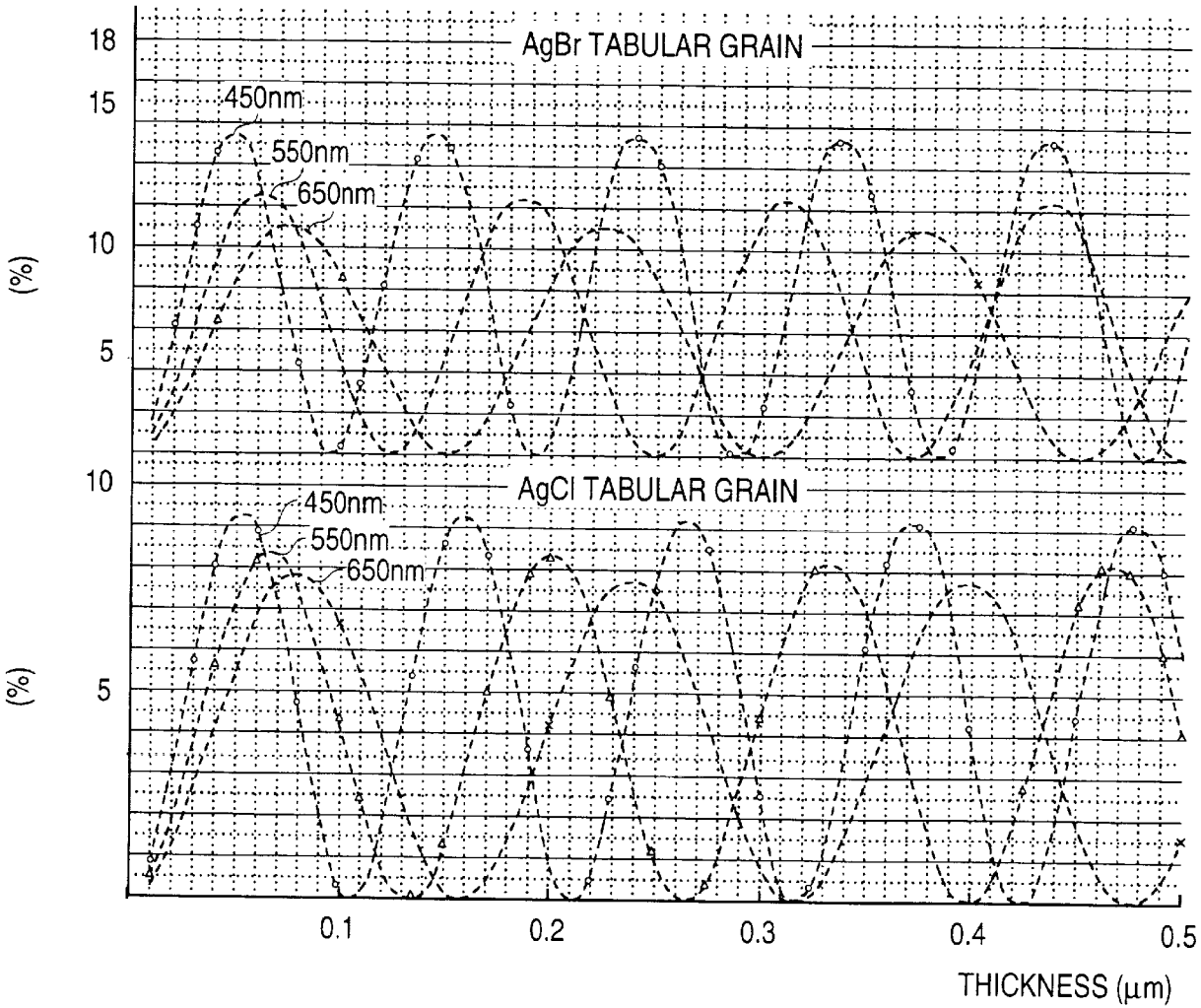
FIG. 6(*a*) shows the relationship between the reflectance of light (%) and the thickness of an AgBr tabular grain, and FIG. 6(*b*) shows the relationship between the reflectance of light (%) and the thickness of an AgCl tabular grain.

The highest reflected light strength $A_1$ and the lowest reflected light strength $A_2$ in equations (a-1) and (a-2) are as follows. For instance, in the case of a large size AgBr tabular grains onto which a sensitizing dye is not adsorbed in which the photosensitive peak wavelength light of a blue-sensitive layer is 450 nm, that of a green-sensitive layer is 550 nm, and that of a red-sensitive layer is 650 nm, the relationship between the layer thickness and the reflectance of light (%) was obtained using the data and the calculating method in FIG. 5. The results obtained are shown in FIG. 6. When the wavelength is fixed, the maximum value of the reflectance is constant. The minimum value is 0.0% in any case. The relationship between the reflectance of light (%) and the thickness of a large size AgCl tabular grain onto which a sensitizing dye is not adsorbed is also shown in FIG. 6. The results of calculation were obtained with making the tabular grain diameter constant and varying the layer thickness. As a result, one to five thickness regions satisfy the conditions in (7); (16) and (18) in item (I) depending on various conditions.

In addition to the above-described additives, various additives can be used in the present invention according to the purpose.

These additives are described in further detail in *Research Disclosure*, No. 17643 (December, 1978), No. 18716 (November, 1979) and No. 308119 (December, 1989) and the locations related thereto are indicated in the following table.

| Type of Additives | RD 17643 | RD 18716 | RD 308119 |
|---|---|---|---|
| 1. Chemical Sensitizers | page 23 | page 648, right column | page 996 |
| 2. Sensitivity Increasing Agents | — | page 648, right column | — |
| 3. Spectral Sensitizers and Supersensitizers | pages 23–24 | page 648, right column to page 649, right column | pages 996, right column to page 998, right column |
| 4. Brightening Agents | page 24 | page 647, right column | page 998, right column |
| 5. Antifoggants and Stabilizers | pages 24–25 | page 649, right column | page 998, right column to page to page 1000, right column |
| 6. Light Absorbers, Filter Dyes, and Ultraviolet Absorbers | pages 25–26 | page 649, right column to page 650, left column | page 1000, left column to page 1003, right column |
| 7. Antistaining Agents | page 25, right column | page 650, left to right columns | page 1002, right column |
| 8. Dye image Stabilizers | page 25 | — | page 1002, right column |
| 9. Hardening Agents | page 26 | page 651, left column | page 1004, right column to page 1005, left column |
| 10. Binders | page 26 | page 651, left column | page 1003, right column to page 1004, right column |
| 11. Plasticizers and Lubricants | page 27 | page 650, right column | page 1006, left column to page 1006, right column |

-continued

| Type of Additives | RD 17643 | RD 18716 | RD 308119 |
|---|---|---|---|
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |
| 14. Matting Agents | — | — | page 1008, left column to page 1009, left column |

Various color couplers can be used in the photosensitive material according to the present invention, and the specific examples are described in the above *Research Disclosure*, No.17643, VII-C to G and *ibid.*, No. 307105, VII-C to G.

Yellow Couplers

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), column 1, lines 45 to 55 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), lines 36 to 58, column 7 of U.S. Pat. No. 4,476,219 (in particular, II-17 and II-19 (column 17), and II-24 (column 19)).

Magenta Couplers

L-57 (page 11, right lower column), L-68 (page 12, right lower column), and L-77 (page 13, right lower column) of JP -A-3-39737; [A-4]-63 (page 134), and [A-4]-73 and [A-4]-75 (page 139) of EP-A-456257; M-4 and M-6 (page 26) and M-7 (page 27) of EP-A-486965; M-45 (page 19) of EP-A-571959; (M-1) (page 6) of JP-A-5-204106; and M-22, paragraph 0237 of JP-A-4-362631.

Cyan Couplers

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers

P-1 and P-5 (page 11) of JP-A-2-44345.

Couplers the Colored Dyes of Which Have an Appropriate Diffusibility

The couplers disclosed in U.S. Pat. No. 4, 366,237, British Patent 2,125,570, EP-B-96873 and German Patent 3,234, 533 are preferred as couplers the colored dyes of which have an appropriate diffusibility.

Couplers for Correcting the Unnecessary Absorption of Colored Dyes

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development Inhibitor-releasing Compounds the compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58)); the compounds represented by formula (I) disclosed on page 7 of EP-A-436938 (in particular, D-49 (page 51)); the compounds represented by formula (1) disclosed in EP-A-568037 (in particular, (23) (page 11); and the compounds represented by formula (I), (II) or (III) disclosed on pages 5 and 6 of EP-A-440195 (in particular, I-(1) on page 29);

Bleaching Accelerator-releasing Compounds the compounds represented by formula (I) or (I') disclosed on page 5 of EP-A-310125 (in particular, (60) and (61) on page 61); and the compounds represented by formula (I) disclosed in claim 1 of JP-A-6-59411 (in particular, (7) on page 7);

Ligand-releasing Compounds the compounds represented by LIG-X disclosed in claim 1 of U.S. Pat. No. 4,555,478 (in particular, the compounds in lines 21 to 41, column 12);

Leuco Dye-releasing Compounds

Compounds 1 to 6, columns 3 to 8 of U.S. Pat. No. 4,749,641;

Fluorescent Dye-releasing Compounds the compounds represented by COUP-DYE disclosed in claim 1 of U.S. Pat. No. 4,774,181 (in particular, compounds 1 to 11, columns 7 to 10);

Development Accelerator-releasing or Fogging Agent-releasing Compounds the compounds represented by formula (1), (2) or (3), column 3 of U.S. Pat. No. 4,656, 123 (in particular, (I-22), column 25); and Compound ExZK-2, lines 36 to 38, page 75 of EP-A-450637; and Compounds Which Release Dyes the Color of which is Restored After Elimination the compounds represented by formula (I) disclosed in claim 1 of U.S. Pat. No. 4,857,447 (in particular, Y-1 to Y-19, columns 25 to 36).

Chemical Sensitization

As the selenium compounds which are used for chemical sensitization of an AgX emulsion, the following compounds are preferably used, e.g., colloidal selenium, selenoureas, selenoketones, selenoamides, selenophosphates, selenides (e.g., dialkyl selenides, diaryl selenides, diacyl selenides, dicarbamoyl selenides, bis(alkoxycarbonyl) selenides), diselenides (dialkyl diselenides, diaryl diselenides), polyselenides, phosphineselenides, selenoesters, triselenanes, selenocarboxylic acids, SeCN salts, selenazoles, quaternary salts of selenazoles, selenious acid, and isocyanoselenates (e.g., allylisocyanoselenates), and selenoureas, selenophosphates, selenides, and phosphineselenides are more preferably used.

Tellurium sensitizers can also be used in combination, and the addition amount is preferably in a molar amount of (the amount of Te/(sulfur, selenium, the total amount of the tellurium sensitizers) of from 0.01 to 0.5, and more preferably from 0.03 to 0.3. It is preferred to use gold sensitizers in combination. The total amount of the chalcogen sensitizers and the amount of gold sensitizers are respectively preferably from $10^{-9}$ to $10^{-3}$ mol per mol of the AgX grains.

The development processes described in RD, No. 17643, pp. 28 and 29, *ibid.*, No. 18716, p. 651, from left column to right column, and *ibid.*, No. 307105, pp. 880 and 881 can be used for the development process of the color photographic material of the present invention.

The photographic material of the present invention is subjected to desilvering process after development.

In the case of the black-and-white photographic material, the material in general undergoes the processes of (development→stopping→fixing→washing→drying), and the residual AgX grains in the photographic material after development are removed from the photographic material by fixing. In the case of a color negative film and color paper, the developed silver and the residual AgX grains are removed from the photographic material by bleaching, fixing and washing after color development. The developed silver is oxidized in a bleaching bath and converted to $Ag^+$ (in general, converted to AgX), and then removed by fixing. Bleaching and fixing can be performed simultaneously in blixing process. A color negative film is generally processed by (color development→bleaching→washing→fixing→washing→stabilizing→drying), color paper is generally processed by (color development→blixing washing→drying), and a color reversal film is generally processed by (first black-and-white development→washing→fogging→color development→adjusting bath→bleaching→fixing→washing→stabilizing→drying).

In fixing process, $Ag^+$ is subjected to reaction with a compound capable of forming a soluble complex, thereby the residual AgX grains are dissolved and removed from the photographic material, and in many cases, thiosulfate, thiocyanate, thioethers are used as such a compound. Oxidizing agents which oxidize silver but not oxidize a color image are used in a bleaching agent, e.g., red prussiate, bichromate, ethylenediaminetetraacetic acid iron(III) salts, alkylenediaminetetraacetic acid iron(III) salts, and aminopolycarboxylic acids are used. Bleach accelerating agents can also be used in combination, which act to accelerate the contact of oxidizing agents with silver on the surface of silver.

Details of these developing processes and processing solutions are disclosed in JP-A-1-297649 and can be referred to.

Literature

1. Compiled by James, *The Theory of the Photographic Process*, Macmillan Co. (1977)
2. *Physical Review*, B4, (10), pp. 3651–3659 (1971)
3. Max Born et al., *Principles of Optics,* 5th Ed., Pergamon Press Co. (1975)

EXAMPLE

The present invention will be illustrated in more detail with reference to examples, comparative examples and reference examples below.

Comparative Example 1

A coated sample having a photosensitive layer (corresponding to Coated Sample No. 116 in Example 1 of JP -A-9-325450) was prepared according to the description of JP -A-9-325450 except that the halogen composition of the AgX {111} tabular grains used in the photosensitive layer was replaced with AgBrI having an AgI content of 0 2 mol %. The obtained sample was designated Comparative Sample No. 1. The shape characteristic values of the tabular grains (average equivalent-circle diameter (μm) of projected area, average thickness (μm), variation coefficient of the diameter (standard deviation of the diameter distribution/average diameter)) are shown in Table 2, the column of Comparative Example 1.

As sensitizing dyes, B1 to B4 were used for a blue-sensitive layer, G1 to G4 for a green-sensitive layer, and R1 to R4 for a red-sensitive layer each in an equivalent amount. Five minutes after J-aggregate splitting agent and Compound 1 as an antifoggant were added, each sensitizing dye was added as a sensitizing dye solution in order of number with the intervals of 5 minutes. The temperature of each system was 43° C. After all the dyes were added, each solution was allowed to stand for 10 minutes, and then the temperature was raised to 65° C. and again allowed to stand for 15 minutes.

After grain formation, a sensitizing dye was added to each emulsion in an amount of 75% of the saturated adsorption amount, then the reaction solution was washed with water and redispersed. Subsequently, the temperature was lowered to 55° C., and a gold sensitizer (an aqueous solution containing chloroauric acid and NaSCN in a molar ratio of 1/20) was added in an amount of gold of $1\times10^{-5}$ mol/mol-AgX, and 2 minutes after a chalcogenide sensitizer SX1 was added in an amount of Se of $0.8\times10^{-5}$ mol/mol-AgX. The reaction solution was ripened for 25 minutes, then the temperature was reduced to 40° C., thereby an AgX emulsion was obtained. Subsequently, materials for a color photograph, a thickener, a hardening agent and a surfactant were added thereto and the obtained coating solution was coated on a support.

Symbols used in Table 2 are the emulsion name of each AgX emulsion. Average diameter (μm)/average thickness (μm), variation coefficient of the diameter distribution (C.V. value) of the tabular grains of each emulsion are as follows. Further, the projected area ratio of tabular grains having an aspect ratio of from 2 to 300 among all the AgX grains was from 98 to 100% in every emulsion.

(A-1): (1.12/0.238), 0.30
(A-2): (0.85/0.165), 0.23
(A-3): (0.55/0.12), 0.19
(A-4): (1.10/0.175), 0.23
(A-5): (1.10/0.157), 0.23
(A-6): (0.58/0.181), 0.19
(A-7): (0.86/0.139), 0.20
(B-1): (1.30/0.135), 0.12
(B-2): (1.0/0.135), 0.14
(B-3): (0.60/0.135), 0.16
(B-4): (1.30/0.145), 0.12
(B-5): (1.10/0.145), 0.14
(B-6): (0.60/0.145), 0.16
(B-7): (1.35/0.02), 0.22
(B-8): (1.05/0.02), 0.24
(B-9): (0.60/0.02), 0.26
(B-10): (1.35/0.135), 0.14
(B-11): (1.35/0.145), 0.13

B-1: 5'-Chloro-3,3'-bis(4-sulfonatobutyl)thiacyanine triethylammonium salt

B-2: 5'-Phenyl-3'-(4-sulfonatobutyl)-3-(3-sulfonato-propyl) oxathiacyanine sodium salt B-3: 4,5-Benzo-5'-chloro-3,3'-bis(3-sulfonatopropyl)-thiacyanine triethylammonium salt B-4: 4,5-Benzo-5'-methoxy-3,3'-bis(3-sulfonatopropyl)-thiacyanine triethylammonium salt G-1: 5,5'-Dichloro-9-ethyl-3,3'-bis(3-sulfonatopropyl)-oxacarbocyanine sodium salt G-2: 9-Ethyl-5'-phenyl-3,3'-bis(2-sulfonatoethyl)-oxacarbocyanine pyridinium salt G-3: 5-Chloro-9-ethyl-5'-phenyl-3'-(2-sulfonatoethyl)-3-(3-sulfonatopropyl)oxacarbocyanine triethylammonium salt G-4: 9-Ethyl-5,6-dimethyl-5'-phenyl-3'-(2-sulfonatoethyl) -3-(4-sulfonatobutyl)oxathiacarbocyanine sodium salt R-1: 5,5'-Dichloro-9-ethyl-3,3'-bis(3-sulfonatopropyl) -thiacarbocyanine pyridinium salt R-2: 5-Carboxy-5'-chloro-3',9-diethyl-3-(4-sulfonato -butyl) thiacarbocyanine R-3:4', 5'-Benzo-5-chloro-9-ethyl-3-(4-sulfonatobutyl)-3-(3-sulfonatopropyl)oxathiacarbocyanine sodium salt R-4: 4,5,4',5'-Dibenzo-9-ethyl-3,3'-bis(3-sulfonato -propyl) thiacarbocyanine triethylammonium salt

TABLE 1

| | Example 1 | | | Example 2 | | | |
|---|---|---|---|---|---|---|---|
| Fine Particles Having High Refractive Index | B | G | R | B | G | R | Remarks |
| 1 MT-100 (mfd. by Dainichiseika) (rutile\|$Al_2O_3$) | 103 | 104 | 104 | 105 | 106 | 106 | Comp. |
| 2 P-25 (mfd. by Degussa) Anatase | " | " | " | " | " | " | Comp. |
| 3 AMT-100 (mfd. by Teikoku Kako) Anatase | " | " | " | " | " | " | Comp. |
| 4 AMT-600 (mfd. by Teikoku Kako) Anatase | " | " | " | " | " | " | Comp. |
| 5 ST-157 (mfd. by Teikoku Kako) Anatase | " | " | " | " | " | " | Comp. |
| 6 TTO-55A (mfd. by Ishihara Sangyo) (rutile\|$Al_2O_3$) | 104 | 105 | 105 | 106 | 107 | 107 | Comp. |
| 7 TTO-51A (mfd. by Ishihara Sangyo) (rutile\|$Al_2O_3$) | " | " | " | " | " | " | Comp. |
| 8 TTO-51A (pulverized in gelatin-1 solution) | 122 | 123 | 123 | 124 | 125 | 125 | Invention |
| 9 TTO-51A (pulverized in gelatin-2 solution) | 123 | 124 | 125 | 125 | 126 | 126 | Invention |
| 10 TTO-51A (pulverized in gelatin-3 solution) | 121 | 122 | 122 | 123 | 124 | 124 | Invention |
| 11 AMT-100 (pulverized in gelatin-1 solution) | 122 | 123 | 124 | 124 | 125 | 125 | Invention |
| 12 P-25 (pulverized in gelatin-1 solution) | 121 | 122 | 123 | 123 | 124 | 124 | Invention |
| 13 Hydrolyzed product 1 of $Ti(OR)_4$ | 135 | 136 | 136 | 136 | 137 | 137 | Invention |
| 14 Hydrolyzed product 2 of $Ti(OR)_4$ | 138 | 139 | 140 | 140 | 141 | 141 | Invention |
| 15 Hydrolyzed product 3 of $Ti(OR)_4$ | 130 | 131 | 132 | 132 | 133 | 133 | Invention |
| 16 Hydrolyzed product 4 of $Ti(OR)_4$ | 133 | 134 | 135 | 135 | 136 | 136 | Invention |
| 17 AgBr ultrafine particles | 117 | 118 | 118 | 119 | 120 | 120 | Invention |
| 18 AgBrI ultrafine particles | 118 | 119 | 119 | 120 | 121 | 121 | Invention |

TABLE 2

| | Comparative Example 1 | Reference Example 1 | Reference Example 2 | Reference Example 3 | Reference Example 5 | Reference Example 6 |
|---|---|---|---|---|---|---|
| Blue-sensitive first layer | (A-1) | (B-1) | (B-7) | (B-7) | (B-1) | (B-7) |
| Blue-sensitive second layer | (A-2) | (B-2) | (B-8) | (B-8) | (B-10) | (B-8) |
| Blue-sensitive third layer | (A-3) | (B-3) | (B-9) | (B-9) | (B-3) | (B-9) |
| Green-sensitive first layer | (A-4) | (B-1) | (B-1) | (B-7) | (B-1) | (B-1) |
| Green-sensitive second layer | (A-5) | (B-2) | (B-2) | (B-8) | (B-10) | (B-2) |
| Green-sensitive third layer | (A-6) | (B-3) | (B-3) | (B-9) | (B-3) | (B-3) |
| Red-sensitive first layer | (A-5) | (B-4) | (B-4) | (B-4) | (B-4) | (B-4) |
| Red-sensitive second layer | (A-7) | (B-5) | (B-5) | (B-5) | (B-11) | (B-5) |
| Red-sensitive third layer | (A-6) | (B-6) | (B-6) | (B-6) | (B-6) | (B-6) |
| Blue light (sensitivity/granurality) | 100 | 115 | 117 | 119 | 120 | shown in Table 1 |

TABLE 2-continued

| | Comparative Example 1 | Reference Example 1 | Reference Example 2 | Reference Example 3 | Reference Example 5 | Reference Example 6 |
|---|---|---|---|---|---|---|
| Green light (sensitivity/granurality) | 100 | 116 | 118 | 120 | 121 | |
| Red light (sensitivity/granurality) | 100 | 115 | 117 | 119 | 120 | |

SX1

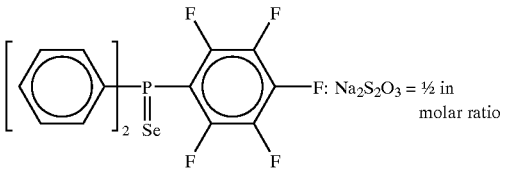

Compound 1

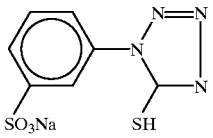

Compound 2

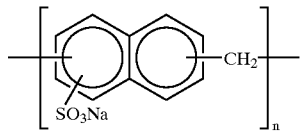

n = 3 ~ 4

Compound 3

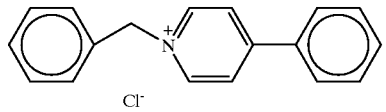

Compound 4

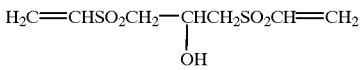

Reference Example 1

Coated Sample No. 1 was prepared in the same manner as in Comparative Example 1 except that the tabular grain emulsions used in Comparative Example 1 were replaced with the emulsions shown in Reference Example 1 in Table 2. Any of these was AgBrI having an AgI content of 0.2 mol %. Any tabular grain in the blue-sensitive layer in Reference Example 1 has low reflectance to a green light and a red light, any tabular grain in the green-sensitive layer has low reflectance to a red light, and any tabular grain in the red-sensitive layer has low reflectance to a red light.

Reference Example 2

Coated Sample No. 2 was prepared in the same manner as in Reference Example 1 except that the tabular grain emulsions used in Reference Example 1 were replaced with the emulsions shown in Reference Example 2 in Table 2.

Different from Reference Example 1, the blue light reflectance of the blue-sensitive layer alone of Coated Sample No. 2 is made lower than that of Reference Example 1.

Reference Example 3

Coated Sample No. 3 was prepared in the same manner as in Reference Example 1 except that the tabular grain emulsions used in Reference Example 1 were replaced with the emulsions shown in Reference Example 3 in Table 2.

Different from Reference Example 2, the tabular grains in the green-sensitive layer alone of Coated Sample No. 3 are ultrathin tabular grains. The light reflectance to a red light and a green light is made low.

Reference Example 4

Coated Sample No. 4 was prepared in the same manner as in Reference Example 1 except that the tabular grain emulsions used in Reference Example 1 were replaced with the emulsions shown in Reference Example 4 in Table 2.

Different from Reference Example 1, in each of the blue-sensitive layer, the green-sensitive layer, and the red-sensitive layer, the average diameter of the tabular grains of the second layer is larger than that of the first layer, and a spectral sensitizing dye is added to the AgX emulsion of the second layer in an amount of 97% of the saturated adsorption amount and is adsorbed in the form of J-aggregate. The sensitivity of the second layer is lower than the sensitivity of the first layer by about 0.3, and the second layer functions as the reflective layer and the image-forming layer due to this constitution.

Examples 1 and 2

Various kinds of inorganic fine particles having a high refractive index as shown in Table 1 were added to each of the emulsions of the blue-sensitive layer, a green-sensitive layer and a red-sensitive layer of Reference Examples 4 and 5 shown in Table 2 in the amount to make the refractive index value of the dispersion phase to 500 nm light of the blue-sensitive layer 1.78, a green-sensitive layer 1.74 and a red-sensitive layer 1.70, respectively.

The same inorganic fine particles were added to a yellow filter layer (an interlayer between the red-sensitive layer and the green-sensitive layer) and the refractive index value of the former was adjusted to 1.76 and the latter to 1.72. A coated sample was prepared and the preparation procedure was carried out in the same manner as in Example 1 of JP-A-9-325450 hereafter.

Each coated sample was subjected to white light exposure for $10^{-2}$ seconds through an optical wedge, development processed through all the process of the color development process (including fixing process) disclosed in Example 1 in JP-A-9-325450, and then sensitometry was performed with a blue light, a green light and a red light. Sensitivity/granularity obtained from the characteristic curve obtained above is shown in Tables 1 and 2. The sensitivity is the reciprocal of the exposure amount (lux.sec) to give the density of (fog+0.2). The sample was uniformly exposed by exposure amount giving the density of (fog+0 2) for $10^{-2}$ seconds and development processed. The unevenness of density of the developed sample was measured with a microdensitometer using a circular aperture having a diameter of 48 $\mu$m, and rms granularity $\sigma$ was obtained. Details are described in Clause 7, Chapter 21 of literature 1. Every $Z_1$ value and $Z_2$ value of the samples with which the characteristic curves were obtained were 0.005 or less.

From the results in Reference Examples 1 to 5, the effect of the present invention was confirmed.

Examples 1 and 2 shows the effect of the color photographic material which contains titanium oxide fine particles according to the present invention.

In Table 1, from (1) to (7) are the mode of adding commercially available secondary agglomerated titanium oxide particles to AgX emulsion as they are, which are comparative examples. (8) are particles obtained by pulverizing commercially available TTO-51A titanium oxide particles in a 0.7 wt % aqueous solution of alkali-processed ossein gelatin using a pulverizer and almost 100% of the secondary agglomerated particles are separated and dispersed in primary particles.

(9) are particles obtained by pulverizing commercially available TTO-51A in a 0.7 wt % aqueous solution (pH 6.0, 25° C.) containing gelatin having the weight average molecular weight of $2\times10^4$, the gelatin was decomposed by enzyme. (10) are particles obtained by pulverizing TTO-51A in a 0.7 wt % aqueous solution (pH 6.0, 25° C.) containing phthalated gelatin in which 50% of amino groups have been phthalated. (11) and (12) are particles obtained by pulverizing commercially available titanium oxide in gelatin-1 solution.

(13) to (16) are titanium oxide particles obtained by adding 100 ml of $Ti(O\text{-isopropyl})_4$ solution to 1,000 ml of HCl acidic solution with stirring at 25° C. to perform hydrolysis. In (13), hydrolysis was performed in HCl (1N) solution, and after one hour, the obtained titanium oxide was mixed with 1,100 ml of gelatin solution-1 (a 0.6 wt % solution containing alkali-processed ossein gelatin, pH 6.0), heated at 70° C. for one hour to accelerate crystallization. The temperature was then lowered to 40° C., the gelatin and Compound 2 were added thereto, and pH was adjusted to 4.0 with NaOH and $HNO_3$ solution and stirring was stopped to effect agglomeration precipitation. The supernatant was removed. Pure water was added and gently stirred the solution, then stirring was stopped and supernatant was eliminated two times. pH was adjusted to 6.0 with NaOH (1N) solution. Agglomerated substance of gelatin was dispersed.

In (14), hydrolysis was performed in HCl (3N) solution, and the same procedure as in (13) was performed hereafter. The particles showing the titanium oxide particle structure obtained at this time were not agglomerated but dispersed dependently.

In (15), hydrolysis was performed in HCl (1N) solution, after 24 hours had passed, 300 ml of gelatin-2 solution (a 3.0 wt % solution containing alkali-processed ossein gelatin, pH 6.0) was added to the above solution, Compound 2 was added thereafter, and agglomeration precipitation and washing was performed in the same manner as above. An NaOH solution was added there to to adjust pH to 6.0, and the agglomerate was redispersed. The dispersion was pulverized with the pulverizer, thereby the agglomerate of grains was thoroughly separated and dispersed.

In (16), hydrolysis was performed in HCl (1N) solution, after 24 hours had passed, the temperature was raised to 70° C. and heated for 60 minutes. The sample was taken out. Then, 300 ml of gelatin solution-2 was added thereto and the same procedure as in (15) was performed hereafter, thereby titanium oxide dispersion was obtained. The sample was taken out. Almost 100% of the titanium oxide ultrafine particles obtained in (13) to (16) were rutile type.

In (17) and (18), AgX ultrafine particles described later were used. Each of the prepared coated samples was subjected to white light exposure for 0.01 seconds through an optical wedge, development processed according to the color development process disclosed in Reference Example 1 in JP-A-9-325450, and then sensitometry was performed with a blue light, a green light and a red light. The relative value of the measured sensitivity/granularity is shown in Tables 1 and 2.

A protective layer (first and second protective layers) was coated on a transparent cellulose triacetate film support by the same protective layer formulation used above in the preparation of samples in the same thickness, and dried. The protective layer surface was faced with the light source side, and the rate of light absorption of 330 to 380 nm light was searched for with a sample not having a protective layer as a reference sample. It was confirmed that 97% or more of the incident light amount was absorbed by the protective layer Thereby, the modes of (I)-(42) and (I)-(43) were confirmed.

Formation of {111} Tabular Grain Seed Crystal

Preparation of Seed Crystal A-1

To a reaction vessel was added gelatin solution 11 (1,200 ml of $H_2O$, 0.72 g of gelatin A, 0.40 g of KBr, 15 ml of an $HNO_3$ (1N) solution), while maintaining the temperature at 30° C., Ag-11 solution (containing 6.0 g of $AgNO_3$ in 100 ml) and X-11 solution (containing 4.26 g of KBr, 0.012 g of KI, and 0.12 g of gelatin A in 100 ml) were simultaneously added at a rate of 30 ml/min for 1 minute. The solution was stirred for 2 minutes, then 30 ml of KBr-11 solution (containing 10 g of KBr in 100 ml) was added, the temperature was raised to 65° C. over 12 minutes, the reaction solution was ripened for 12 minutes. After pH was adjusted to 9.1 with the addition of an NaOH solution, the solution was ripened for further 10 minutes. Gelatin solution 12 (containing 170 g of $H_2O$ and 20 g of gelatin B) was added and pH was adjusted to 7.0.

While maintaining pBr at 1.65 using Ag-11 solution and X-11 solution, Ag-11 solution was added at a rate of 7.0 ml/min for 10 minutes. At this point, 1 ml of the emulsion was taken out. This emulsion was confirmed to be {111} tabular grains having an average thickness of 0.05 $\mu$m and an average diameter of 0.36 $\mu$m from the from the carbon replica of the transmission type electron microphotograph (TEM image) of the grains. This was designated as Seed Crystal A-1.

Preparation of Seed Crystal A-2

To a reaction vessel was added gelatin solution 13 (1,200 ml of pure water, 20 g of gelatin C, 1.0 g of KBr, 0.05 g of Compound 3, pH: 6.0), while maintaining the temperature at 40° C., Ag-12 solution (containing 10 g of $AgNO_3$ in 100 ml) and X-12 solution (containing 7.2 g of KBr, 0.02 g of KI, 2 g of gelatin C, and 0.02 g of Compound 3 in 100 ml) were simultaneously added at a rate of 6 ml/min for 12 minutes. After the solution was stirred for 3 minutes, the temperature was lowered to 20° C. The obtained tabular grains had an average diameter of 0.25 μm and an average thickness of 0.012 μm. This was designated as Seed Crystal A-2.

Gelatin A

Twenty (20) grams of deionized alkali-processed ossein gelatin having a weight average molecular weight of 20,000 was dissolved in 170 ml of water and pH was adjusted to 6.0, then 0.7 ml of $H_2O_3$ (a 3.1 wt % solution) was added and allowed to stand at 40° C. for 16 hours to obtain a gelatin. The methionine content of the obtained gelatin was about 10 μmol/g.

Gelatin B $H_2O_2$ was added to an aqueous solution of deionized alkali-processed ossein gelatin (ABO) and oxidation was performed, and after the methionine content was made 30 μmol/g, 90% of $-NH_2$ was trimellited to obtain a trimellited gelatin.

Gelatin C $H_2O_2$ was added to an aqueous solution of ABO and oxidation was performed, and the methionine content was made 0 μmol/g to obtaine a gelatin.

Preparation of Emulsion B-1

Half an amount of Seed Crystal A-1 and gelatin solution 15 (containing 600 ml of water and 15 g of gelatin B) were added to a reaction vessel, temperature was adjusted to 65° C., pH 8.6, and pBr 1.7. Ag-15 solution (containing20 g of $AgNO_3$in 100 ml) and X-15 solution (containing 14.6 g of KBr, 0.04 g of KI and 1.5 g of gelatin B in 100 ml) were simultaneously added to the above solution at an initial flow rate of 2 ml/min and an accelerated flow rate of 0.27 ml/min over 55 minutes with maintaining pBr at 1.7 and pHat 8.6. After stirring the mixed solution for 2minutes, the temperature was lowered to 43° C., and then a solution of Compound 2 and a sensitizing dye was added in the same manner as above. Then, a precipitant was added, the temperature was lowered to 30° C., pH was adjusted to near 4.0, the emulsion was washed with water by precipitation washing method, and desalted. A gelatin solution was added thereto, pH was adjusted to 6.4, pBr 2.6 and the temperature to 40° C., and redispersed. Chemical sensitization was performed in the same manner as above.

Preparation of Emulsion B-2

Seed Crystal A-1 was added to a reaction vessel, temperature was adjusted to 65° C. and pH was adjusted to 8.8. Ag-15 solution and X-15 solution were simultaneously added to the above solution at an initial flow rate of 4.0 ml/min and an accelerated flow rate of 0.6 ml/min over 39 minutes with maintaining pBr at 1.7 and pH at 8.8. After stirring the mixed solution for 2 minutes, the same procedure as in the preparation of Emulsion B-1 was performed, thereby Emulsion B-2 was obtained.

Preparation of Emulsion B-3

Seed Crystal A-1 was added to a reaction vessel, temperature was adjusted to 65° C., pBr 1.7, and pH 9.0. Ag-15 solution and X-15 solution were simultaneously added to the above solution at an initial flow rate of 4.0 ml/min and an accelerated flow rate of 0.6 ml/min over 20 minutes with maintaining pBr at 1.7 and pH at 9.0. After stirring the mixed solution for 2 minutes, the same procedure as in the preparation of Emulsion B-1 was performed, thereby Emulsion B-3 was obtained.

Preparation of Emulsion B-4

Half an amount of Seed Crystal A-1, gelatin solution 16 (containing 600 ml of water and 15 g of gelatin C) and 0.3 g of Pluronic 31R-1 (manufactured by BASF Co.) were added to a reaction vessel, while maintaining the temperature at 70° C., pH at 7.0, and pBr at 1.7, Ag-15 solution and X-16 solution (containing 14.6 g of KBr, 0.04 g of KI and 1.5 g of gelatin C in 100 ml) were simultaneously added to the above solution at an initial flow rate of 2 ml/min and an accelerated flow rate of 0.27 ml/min over 57 minutes. After stirring the mixed solution for 2 minutes, the same procedure as in the preparation of Emulsion B-1 was performed hereafter, thereby Emulsion B-4 was obtained.

Preparation of Emulsion B-5

Half an amount of Seed Crystal A-1, gelatin solution 16 and 0.4 g of Pluronic 31R-1 were added to a reaction vessel, while maintaining the temperature at 70° C., pH at 7.0, and pBr at 1.7, Ag-15 solution and X-16 solution were simultaneously added to the above solution at an initial flow rate of 2 ml/min and an accelerated flow rate of 0.27 ml/min over 47 minutes. After stirring the mixed solution for 2 minutes, the same procedure as in the preparation of Emulsion B-1 was performed hereafter, thereby Emulsion B-5 was obtained.

Preparation of Emulsion B-6

Half an amount of Seed Crystal A-1 and 0.5 g of Pluronic 31R-1 were added to a reaction vessel, while maintaining the temperature at 70° C., pH at 7.0, and pBr at 1.7, Ag-15 solution and X-16 solution were simultaneously added to the above solution at an initial flow rate of 4 ml/min and an accelerated flow rate of 0.6 ml/min over 20 minutes. After stirring the mixed solution for 2 minutes, the same procedure as in the preparation of Emulsion B-1 was performed hereafter, thereby Emulsion B-6 was obtained.

Preparation of Emulsion B-7

Seed Crystal A-2 was added to a reaction vessel and the temperature was adjusted to 40° C. While maintaining pBr 1.75 and pH at 6.0, Ag-15 solution and X-17 solution (containing 14.6 g of KBr, 0.04 g of KI, 2 g of gelatin C, and 0.02 g of Compound 3 in 100 ml) were simultaneously added to the above solution at an initial flow rate of 3.5 ml/min and an accelerated flow rate of 0.35 ml/min over 73 minutes.

The temperature was raised at the same time with the start of addition at an increasing rate of 1° C./min to 60° C. After stirring the mixed solution for 2 minutes, the same procedure as in the preparation of Emulsion B-1 was performed hereafter, thereby Emulsion B-7 was obtained.

Preparation of Emulsion B-8

Seed Crystal A-2 was added to a reaction vessel and the temperature was adjusted to 40° C. While maintaining pH at 6.0 and pBr 1.75, Ag-15solution and X-17 solution were simultaneously added to the above solution at an initial flow rate of 3.5 ml/min and an accelerated flow rate of 0.35 ml/min over 55 minutes. The temperature was raised at the same time with the start of addition at an increasing rate of 1° C./min to 60° C. After stirring the mixed solution for 2 minutes, the same procedure as in the preparation of Emulsion B-1 was performed hereafter, thereby Emulsion B-8 was obtained.

Preparation of Emulsion B-9

Seed Crystal A-2 was added to a reaction vessel and pBr was adjusted to 1.8, pH to 6.0 and the temperature to 40° C. Ag-12 solution and X-18 solution (containing 7.5 g of KBr, 0.02 g of KI, 2 g of gelatin C, and 0.02 g of Compound 3 in 100 ml) were simultaneously added to the above solution at an initial flow rate of 7 ml/min and an accelerated flow rate of 0.7 ml/min over 26 minutes with maintaining pBr at 1.8 and pH at 6.0. The temperature was raised at the same time with the start of addition at an increasing rate of 1° C./min to 60° C.

After stirring the mixed solution for 2 minutes, the same procedure as in the preparation of Emulsion B-1 was performed hereafter, thereby Emulsion B-9 was obtained.

Preparation of Emulsion B-10

Half an amount of Seed Crystal A-1 was added to a reaction vessel, and the temperature was adjusted to 65° C., pH to 8.4, and pBr to 1.7. Ag-15 solution and X-15 solution were simultaneously added to the above solution at an initial flow rate of 2 ml/min and an accelerated flow rate of 0.27 ml/min over 57 minutes with maintaining pH at 8.4 and pBr at 1.7. After stirring the mixed solution for 2 minutes, the same procedure as in the preparation of Emulsion B-1 was performed hereafter, thereby Emulsion B-10 was obtained.

Preparation of Emulsion B-11

Half an amount of Seed Crystal A-1, gelatin solution 16 and 0.28 g of Pluronic 31R-1 were added to a reaction vessel, while maintaining the temperature at 70° C., pH at 7.0, and pBr at 1.7, Ag-15 solution and X-16 solution were simultaneously added to the above solution at an initial flow rate of 2 ml/min and an accelerated flow rate of 0.27 ml/min over 60 minutes. After stirring the mixed solution for 2 minutes, the same procedure as in the preparation of Emulsion B-1 was performed hereafter, thereby Emulsion B-11 was obtained.

Emulsions (A-1) to (A-7) were prepared according to the formulation of Emulsions (B-4) to (B-6) with changing the conditions at the time of grain growth. The thickness of the tabular grains becomes thick by the increase of the addition amount of Pluronic, the increase of pH value, the increase of pBr value, the reduction of temperature, and the increase of the methionine content of gelatin.

Preparation of Ultrafine Particles (17)

Into a reaction vessel having the capacity of 4,000 ml was added an aqueous gelatin solution (1,600 ml of an aqueous solution containing 0.6 g of KBr, 20 g of gelatin extracted from the skin of fishes in the cold sea (e.g., a codfish or a sermon), and 10 g of cattle ossein gelatin having a weight average molecular weight of $2\times10^4$ whose pH was adjusted to 5.4 with an NaOH (1N) solution and an $HNO_3$ (1N) solution). Ag-1 solution (containing 30 g of $AgNO_3$ in 100 ml) and X-1 solution (containing 21.1 g of KBr and 1.0 g of the fish gelatin per 100 ml) were simultaneously added to the above solution at a flow rate of 50 ml/min for 30 seconds with maintaining the temperature at 10° C. and vigorously stirring. Subsequently, Ag-1 solution and X-1 solution were simultaneously added at a flow rate of 100 ml/min for 10 minutes. After the pBr of the solution was adjusted to 2.5 with an $AgNO_3$ solution and a KBr solution, 1-phenyl-5-mercaptotetrazole (hereinafter referred to as "PMT") was added thereto as a particle change inhibitor in an amount of 90% of the saturated adsorption amount. After stirring for 5 minutes, the temperature was raised to 35° C. The emulsion was put in a centrifugal separator and centrifuged. The supernatant was removed. An aqueous solution of cattle ossein gelatin (a 3.0 wt % solution containing deionized gelatin having a weight average molecular weight of about $10^5$, pH 6.5 and pBr 2.5) was added to the emulsion and redispersed.

Zero point one (0.1) ml of the emulsion was taken out. This emulsion was confirmed to be AgBr grains having an average diameter of 0.02 μm from the observation of the direct electron microphotograph (direct cool TEM image) performed at −130° C.

Preparation of Ultrafine AgBrI Particles (18)

Into a reaction vessel having the capacity of 4,000 ml was added a dispersion medium aqueous solution (1,600 ml of an aqueous solution containing 0.6 g of KBr, 20 g of fish gelatin, and 10 g of polyvinyl alcohol having an average polymerization degree of 1,700 and saponification degree of 98% or more, pH was adjusted to 5.4). Ag-1 solution and X-2 solution (containing 0.88 g of KI, 20.47 g of KBr, and 1.0 g of the fish gelatin in 100 ml) were simultaneously added to the above solution at a flow rate of 50 ml/min for 30 seconds with maintaining the temperature at 15° C. and vigorously stirring. Subsequently, Ag-1 solution and X-1 solution were simultaneously added at a flow rate of 100 ml/min for 10 minutes.

After grain formation, the emulsion was processed according to the same process as above, and redispersed. Zero point one (0.1) ml of the emulsion was taken out. This emulsion was confirmed to be AgBrI grains having an average diameter of 0.015 μm from the observation of the direct electron microphotograph performed at −130° C. The AgI content obtained from the formulation is about 3.0 mol %.

Example 3

Fine particles shown in Table 1, (8) to (18) were added to Emulsion B-1 which was sensitized for a green-sensitive layer so that the refractive index value of the dispersion medium phase in the emulsion became 1.78. The obtained solution was coated on an undercoated PET support. The same protective layer coating solution as in Example 1 was prepared and coated on the AgX emulsion layer, and then dried. The thickness of the AgX emulsion layer was 3 μm and the thickness of the protective layer was 2 μm. The sample was subjected to exposure with a minus blue light of a wavelength of from 520 to 700 nm for 0.01 seconds through an optical wedge, development processed with MAA-1 developing solution (described in *Journal of Photographic Science*, Vol. 23, pp. 249–256 (1975)) at 20° C. for 10 minutes, fixed, washed, and dried. The following (sensitivity/granularity) values were obtained from black-and-white sensitometry. When the (sensitivity/granularity) of the system to which the fine particles were not added was taken as 100, No. (8) in Table 1 was 124, (9) was 126, (10) was 128, (11) was 125, (12) was 124, (13) was 138, (14) was 141, (15) was 133, (16) was 136, (17) was 120, and (18) was 121. From these results, the effect of the present invention was proved. Examples 4 and 5

The modes of Examples 1 and 2 were applied to the constitution of Example 1 in Japanese Patent Application No. 11-57097. The fourth photosensitive layer was introduced to the lowermost layer of the green-sensitive layer. Coated samples were prepared according to the method in the above patent except that the emulsions of Japanese Patent application No. 11-57097 were replaced with the AgX emulsions shown in Table 3.

The modified refractive index value of each layer due to the high refractive index fine particles was the same as that in Examples 1 and 2, and the refractive index value of the fourth layer was modified to 1.73.

Comparative Example 2

Comparative Sample No. 2 was prepared in the same manner as in the above patent except that the AgX emulsion alone in Example 1 in Japanese Patent Application No. 11-57097 was replaced with the emulsion in Comparative Example 2 in the same molar amount.

Each of the obtained samples was subjected to white light exposure in the same manner as in Examples 1 and 2, development processed through all the process of the same development process (including fixing process) as in Example 1 in Japanese Patent Application No. 11-57097, and sensitometry was performed in the same manner as above. The results obtained are shown in Tables 3 and 4. $Z_1$ value and $Z_2$ value of every sample was 0.005 or less, which proved the effect of the present invention.

TABLE 3

| | Comparative Example 2 | Reference Example 4 | Reference Example 5 | Reference Example 6 | Reference Example 7 | Reference Example 8 |
|---|---|---|---|---|---|---|
| Blue-sensitive first layer | (A-1) | (B-1) | (B-7) | (B-7) | (B-1) | (B-7) |
| Blue-sensitive second layer | (A-2) | (B-2) | (B-8) | (B-8) | (B-10) | (B-8) |
| Blue-sensitive third layer | (A-3) | (B-3) | (B-9) | (B-9) | (B-3) | (B-9) |
| Green-sensitive first layer | (A-4) | (B-1) | (B-1) | (B-7) | (B-1) | (B-1) |
| Green-sensitive second layer | (A-5) | (B-2) | (B-2) | (B-8) | (B-10) | (B-2) |
| Green-sensitive third layer | (A-6) | (B-3) | (B-3) | (B-9) | (B-3) | (B-3) |
| Green-sensitive fourth layer | (A-4) | (B-1) | (B-1) | (B-7) | (B-1) | (B-1) |
| Red-sensitive first layer | (A-5) | (B-4) | (B-4) | (B-4) | (B-4) | (B-4) |
| Red-sensitive second layer | (A-7) | (B-5) | (B-5) | (B-5) | (B-11) | (B-5) |
| Red-sensitive third layer | (A-6) | (B-6) | (B-6) | (B-6) | (B-6) | (B-6) |
| Blue light (sensitivity/granurality) | 100 | 115 | 117 | 119 | 120 | shown in Table 4 |
| Green light (sensitivity/granurality) | 100 | 117 | 119 | 121 | 122 | |
| Red light (sensitivity/granurality) | 100 | 116 | 118 | 120 | 121 | |

TABLE 4

| | Example 5 | | | Example 6 | | | |
|---|---|---|---|---|---|---|---|
| Fine Particles Having High Refractive Index | B | G | R | B | G | R | Remarks |
| 1 MT-100 (mfd. by Dainichiseika) (rutile\|$Al_2O_3$) | 102 | 103 | 103 | 104 | 106 | 106 | Comp. |
| 2 P-25 (mfd. by Degussa) Anatase | " | " | " | " | " | " | Comp. |
| 3 AMT-100 (mfd. by Teikoku Kako) Anatase | " | " | " | " | " | " | Comp. |
| 4 AMT-600 (mfd. by Teikoku Kako) Anatase | " | " | " | " | " | " | Comp. |
| 5 ST-157 (mfd. by Teikoku Kako) Anatase | " | " | " | " | " | " | Comp. |
| 6 TTO-55A (mid. by Ishihara Sangyo) (rutile\|$Al_2O_3$) | 103 | 104 | 104 | 105 | 106 | 106 | Comp. |
| 7 TTO-51A (mfd. by Ishihara Sangyo) (rutile\|$Al_2O_3$) | " | " | " | " | " | " | Comp. |
| 8 TTO-51A (pulverized in gelatin-1 solution) | 122 | 124 | 124 | 124 | 126 | 126 | Invention |
| 9 TTO-51A (pulverized in gelatin-2 solution) | 123 | 125 | 126 | 125 | 127 | 127 | Invention |
| 10 TTO-51A (pulverized in gelatin-3 solution) | 121 | 123 | 123 | 123 | 125 | 125 | Invention |
| 11 AMT-100 (pulverized in gelatin-1 solution) | 122 | 124 | 125 | 124 | 126 | 126 | Invention |
| 12 P-25 (pulverized in gelatin-1 solution) | 121 | 123 | 124 | 123 | 125 | 125 | Invention |
| 13 Hydrolyzed product 1 of $Ti(OR)_4$ | 135 | 137 | 137 | 136 | 138 | 138 | Invention |
| 14 Hydrolyzed product 2 of $Ti(OR)_4$ | 138 | 140 | 141 | 140 | 142 | 142 | Invention |
| 15 Hydrolyzed product 3 of $Ti(OR)_4$ | 130 | 132 | 133 | 132 | 134 | 134 | Invention |
| 16 Hydrolyzed product 4 of $Ti(OR)_4$ | 133 | 135 | 136 | 135 | 137 | 137 | Invention |

TABLE 4-continued

| Fine Particles Having High Refractive Index | Example 5 B | Example 5 G | Example 5 R | Example 6 B | Example 6 G | Example 6 R | Remarks |
|---|---|---|---|---|---|---|---|
| 17 AgBr ultrafine particles | 117 | 119 | 119 | 119 | 121 | 121 | Invention |
| 18 AgBrI ultrafine particles | 118 | 120 | 120 | 120 | 122 | 122 | Invention |

Example 6

6-1) Silver Halide Emulsion Em-a and Em-b were Prepared According to the Following Methods Preparation of Em-a Low molecular weight phthalated gelatin (phthalation rate: 97%) having a molecular weight of 15,000 (31.7 g) and 42.2 liters of an aqueous solution containing 31.7 g of KBr were maintained at 35° C. and vigorously stirred. An aqueous solution (1,583 ml) containing 316.7 g of $AgNO_3$ and 1,583 ml of an aqueous solution containing 221.5 g of KBr and 52.7 g of low molecular weight gelatin having a molecular weight of 15,000 were added to the above solution over one minute with a double jet method. Immediately after the termination of addition, 52.8 g of KBr was added, and 2,485 ml of an aqueous solution containing 398.2 g of $AgNO_3$ and 2,581 ml of an aqueous solution containing 291.1 g of KBr were added to the above solution over two minute with a double jet method. Immediately after the termination of addition, 44.8 g of KBr was added. Thereafter, the temperature was raised to 40° C., and ripening was performed. After termination of ripening, 923 g of low molecular weight phthalated gelatin (phthalation rate: 97%) having a molecular weight of 100,000 and 79.2 g of KBr were added thereto, and 15,947 ml of an aqueous solution containing 5, 103 g of $AgNO_3$ and an aqueous KBr solution were added to the above solution over 10 minute with a double jet method so that the final flow rate became 1.4 times of the initial flow rate. At this time, silver potential was maintained at −60 mV to a saturated calomel electrode. After washing with water, gelatin was added and pH was adjusted to 5.7 and pAg at 8.8. The silver weight per kg of the emulsion was adjusted to 131.8 g and the gelatin weight was adjusted to 64.1 g. Thus, the seed crystals were obtained. An aqueous solution (1,211 ml) containing 46 g of phthalated gelatin (phthalationrate: 97%) and 1.7 g of KBr was maintained at 75° C. and vigorously stirred. After 9.9 g of the above-obtained seed crystals was added to the above solution, 0.3 g of modified silicon oil (L7602, manufactured by Nihon Uniker Co., Ltd.) was added. pH was adjusted to 5.5 with $H_2SO_4$, then 67.6 ml of an aqueous solution containing 7.0 g of $AgNO_3$ and an aqueous KBr solution were added to the above solution over 6 minute with a double jet method so that the final flow rate became 5.1 times of the initial flow rate. At this time, silver potential was maintained at −20 mV to a saturated calomel electrode. After 2 mg of sodium benzenethiosulfonate and 2 mg of thiourea dioxide were added, 328 ml of an aqueous solution containing 105.6 g of $AgNO_3$ and an aqueous KBr solution were added to the above solution over 56 minute with a double jet method so that the final flow rate became 3.7 times of the initial flow rate.

At this time, silver potential was maintained at −50 mV to a saturated calomel electrode. Subsequently, 121.3 ml of an aqueous solution containing 45.6 g of $AgNO_3$ and an aqueous KBr solution were added to the above solution over 22 minute with a double jet method. At this time, silver potential was maintained at +20 mV to a saturated calomel electrode. The temperature of the reaction solution was increased to 82° C., and 206.2 ml of an aqueous solution containing 66.4 g of $AgNO_3$ and an aqueous KBr solution were added to the above solution over 16 minute with a double jet method. At this time, silver potential was maintained at +90 mV to a saturated calomel electrode.

The obtained tabular grains were tabular grains having an equivalent-circle diameter of 2.2 μm, a thickness of 0.22 μm, an aspect ratio of 10, and a variation coefficient of 20%.

After the emulsion was washed with water, gelatin was added and pH was adjusted to 5.8 and pAg to 8.7 at 40° C.

Preparation of Em-b

Em-b was prepared in the same manner as in the preparation of Em-a except that when 206.2 ml of an aqueous solution containing 66.4 g of $AgNO_3$ was added finally, an NaCl solution was added in place of an aqueous KBr solution. The diameter and the shape were the same as those of Em-a.

Preparation of Em-c to Em-f

Em-c was prepared in the same manner as the preparation of Em-a and Em-b except that when 206.2 ml of an aqueous solution containing 66.4 g of $AgNO_3$ was added finally, a KBr solution was added in the first half and an NaCl solution was added in the latter half. Further, Em-d to Em-f were prepared by varying the proportion of addition of a KBr solution and NaCl solution. The diameter and the shape were the same as those of Em-a.

Preparation of Em-g

Pure silver chloride tabular grains were prepared with referring to Emulsion BLC in Example 1 of Japanese Patent Application No. 11-166036.

The grain structures are summarized in Table 5.

Preparation of Coated Sample

The above-obtained emulsion was coated on an undercoated cellulose triacetate film support in coating amount of 0.8 g/m$^2$, thus Sample Nos. 801 to 806 were obtained.

The reflectance of Sample Nos 801 to 806 were measured using a spectrophotometer U-3210 (manufactured by Hitachi, Ltd.)

The results obtained are shown in Table 5.

TABLE 5

| Sample No. | Emulsion Name | Equivalent-Circle Diameter (μm) | Average Grain Thickness (μm) | Thickness of Silver Chloride Layer (μm) | Reflectance of Coated Layer (%) |
|---|---|---|---|---|---|
| 801 | Em-a | 2.2 | 0.22 | 0 | 13 |
| 802 | Em-c | 2.2 | 0.22 | 0.04 | 8 |
| 803 | Em-d | 2.2 | 0.22 | 0.05 | 5 |
| 804 | Em-e | 2.2 | 0.22 | 0.07 | 3 |
| 805 | Em-f | 2.2 | 0.22 | 0.09 | 4 |
| 806 | Em-b | 2.2 | 0.22 | 0.1 | 5 |
| 807 | Em-g | 2.2 | 0.22 | 0.11 | 7 |

The reflectance of Sample No. 801 was 13%. However, it is clearly seen from the results in Table 5 that the reflectance is changed by changing the thickness of the silver chloride layer. It is clearly seen that the reflectance is not simply reduced with the thickness of the silver chloride layer but it has the minimum. It is clearly seen that the reflectance values of Sample Nos. 803 to 806 are lower than that of the pure silver chloride tabular grain.

That is, the present inventors have found the tabular grains having lower reflectance than both silver bromide tabular grains and pure silver chloride tabular grain.

Now, Emulsions D to T were prepared by the ordinary method. The obtained results are shown in Tables 6 and 7 below.

TABLE 6

| Emulsion No. | Equivalent-Circle Diameter (μm) Variation Coefficient (%) | Thickness (μm) Variation Coefficient (%) | Aspect Ratio (μm) Variation Coefficient (%) | Tabularity | Distance between Twin Planes (μm) Variation Coefficient (%) |
|---|---|---|---|---|---|
| D | 1.98<br>23 | 0.198<br>28 | 10<br>35 | 51 | 0.014<br>32 |
| E | 1.30<br>25 | 0.108<br>27 | 12<br>38 | 111 | 0.013<br>30 |
| F | 1.00<br>27 | 0.083<br>26 | 12<br>37 | 145 | 0.012<br>30 |
| G | 0.75<br>31 | 0.075<br>18 | 10<br>29 | 133 | 0.010<br>27 |
| H | 2.01<br>18 | 0.161<br>18 | 12.5 | 78 | 0.011<br>23 |
| I | 1.54<br>26 | 0.077<br>18 | 20<br>33 | 260 | 0.013<br>26 |
| J | 1.08<br>18 | 0.072<br>15 | 15<br>19 | 208 | 0.008<br>22 |
| K | 0.44<br>16 | 0.220<br>13 | 2<br>9 | 9 | 0.013<br>18 |

| Sample No. | Proportion of {111} Main Plane Tabular Grain in Total Projected Area (%) | Ratio of {100} Faces at Side Surface (%) | AgI Content (mol %) Variation Coefficient (%) | AgCl Content (mol %) | AgI Content on Surface (mol %) |
|---|---|---|---|---|---|
| D | 92 | 23 | 15<br>17 | 0 | 4.3 |
| E | 93 | 22 | 11<br>16 | 0 | 3.6 |
| F | 93 | 18 | 4<br>8 | 1 | 1.8 |
| G | 91 | 33 | 4<br>8 | 2 | 1.9 |
| H | 99 | 23 | 3.9<br>5 | 0 | 6.1 |
| I | 99 | 23 | 8.4<br>8 | 0 | 6.2 |
| J | 97 | 23 | 6<br>5 | 0 | 2.0 |
| K | 90 | 38 | 3<br>6 | 2 | 1.0 |

TABLE 7

| Emulsion No. | Equivalent-Circle Diameter (μm) Variation Coefficient (%) | Thickness (μm) Variation Coefficient (%) | Aspect Ratio (μm) Variation Coefficient (%) | Tabularity | Distance of Twin Planes (μm) Variation Coefficient (%) |
|---|---|---|---|---|---|
| L | 0.33<br>17 | 0.165<br>13 | 2<br>12 | 12 | 0.013<br>18 |
| M | 2.25<br>31 | 0.107<br>19 | 21<br>34 | 197 | 0.013<br>33 |

TABLE 7-continued

| | | | | | |
|---|---|---|---|---|---|
| N | 2.38 | 0.138 | 17 | 125 | 0.013 |
| | 20 | 20 | 23 | | 19 |
| O | 1.83 | 0.122 | 15 | 123 | 0.012 |
| | 18 | 20 | 22 | | 19 |
| P | 0.84 | 0.120 | 7 | 58 | 0.013 |
| | 17 | 18 | 19 | | 16 |
| Q | 0.44 | 0.220 | 2 | 9 | 0.013 |
| | 17 | 13 | 12 | | 18 |
| R | 0.33 | 0.165 | 2 | 12 | 0.013 |
| | 17 | 13 | 12 | | 18 |
| S | 0.07 | 0.070 | 1 | — | — |
| | — | — | — | | — |
| T | 0.07 | 0.070 | 1 | — | — |
| | — | — | — | | — |

| Sample No. | Proportion of {111} Main Plane Tabular Grain in Total Projected Area (%) | Ratio of {100} Faces at Side Surface (%) | AgI Content (mol %) Variation Coefficient (%) | AgCl Content (mol %) | AgI Content on Surface (mol % |
|---|---|---|---|---|---|
| L | 88 | 42 | 3 | 2 | 1.0 |
| | | | 6 | | |
| M | 99 | 20 | 7.2 | 0 | 2.4 |
| | | | 7 | | |
| N | 98 | 23 | 5 | 1 | 1.6 |
| | | | 6 | | |
| O | 98 | 23 | 5 | 1 | 1.8 |
| | | | 6 | | |
| P | 99 | 25 | 3 | 0 | 2.7 |
| | | | 7 | | |
| Q | 88 | 42 | 2 | 2 | 1.0 |
| | | | 6 | | |
| R | 88 | 46 | 1 | 2 | 0.5 |
| | | | 6 | | |
| S | — | — | 1 | 0 | — |
| | | | — | | |
| T | — | — | 0.9 | 0 | — |
| | | | — | | |

6-2) Preparation of Support

PEN film was used as a support.

The constitution of PEN film, an undercoating layer, a backing layer, an antistatic layer, a magnetic recording layer, a sliding layer, etc., were conducted completely the same as the description in Example of Japanese Patent Application No. 11-246491 (paragraphs 0327–0332).

6-3) Coating of Photosensitive Layer (Sample No. 901)

On the opposite side of the backing layer of the PEN support of the thus-obtained, the following first layer to sixteenth layer were multilayer coated to prepare color negative photographic material Sample No. 901.

Of the additives of each layer, additives represented by symbols, e.g., ExC, ExM, ExY, are the compounds having the same structure as the compounds of (ka 36) to (ka 51) in Japanese Patent Application No. 11-246491.

Further, addition of surfactants and metal salts to each layer, preparation of organic solid dispersion of dyes, preparation of solid dispersion of sensitizing dyes, etc., are also the same as the description in Japanese Patent Application No. 11-246491 (paragraphs 0273–0278).

The numeral corresponding to each component indicates the coated weight in unit of $g/m^2$, and the coated weight of silver halide is shown by the weight calculated as silver.

TABLE 8

| | |
|---|---|
| **First Layer: First Antihalation Layer** | |
| Black Colloidal Silver | 0.155 as silver |
| Silver Iodobromide Emulsion T | 0.01 as silver |
| Gelatin | 0.87 |
| ExC-1 | 0.002 |
| ExC-3 | 0.002 |
| Cpd-2 | 0.001 |
| HBS-1 | 0.004 |
| HBS-3 | 0.002 |
| **Second Layer: Second Antihalation Layer** | |
| Black Colloidal Silver | 0.066 as silver |
| Gelatin | 0.407 |
| ExM-1 | 0.050 |
| ExF-1 | $2.0 \times 10^{-3}$ |
| HBS-1 | 0.074 |
| Solid Dispersion Dye ExF-2 | 0.015 |
| Solid Dispersion Dye ExF-3 | 0.020 |
| **Third Layer: Interlayer** | |
| Silver Iodobromide Emulsion S | 0.020 |
| ExC-2 | 0.022 |
| Polyethyl Acrylate Latex | 0.085 |
| Gelatin | 0.294 |
| **Fourth Layer: Low-Speed Red-Sensitive Emulsion Layer** | |
| Silver Iodobromide Emulsion R | 0.065 as silver |
| Silver Iodobromide Emulsion Q | 0.258 as silver |
| ExC-1 | 0.109 |
| ExC-3 | 0.044 |
| ExC-4 | 0.072 |
| ExC-5 | 0.011 |
| ExC-6 | 0.003 |
| Cpd-2 | 0.025 |
| Cpd-4 | 0.025 |
| HBS-1 | 0.17 |
| Gelatin | 0.80 |

TABLE 8-continued

| | |
|---|---|
| **Fifth Layer: Medium-Speed Red-Sensitive Emulsion Layer** | |
| Silver Iodobromide Emulsion P | 0.21 as silver |
| Silver Iodobromide Emulsion O | 0.62 as silver |
| ExC-1 | 0.14 |
| ExC-2 | 0.026 |
| ExC-3 | 0.020 |
| ExC-4 | 0.12 |
| ExC-5 | 0.016 |
| ExC-6 | 0.007 |
| Cpd-2 | 0.036 |
| Cpd-4 | 0.028 |
| HBS-1 | 0.16 |
| Gelatin | 1.18 |
| **Sixth Layer: High-Speed Red-Sensitive Emulsion Layer** | |
| Silver Iodobromide Emulsion N | 1.47 as silver |
| ExC-1 | 0.18 |
| ExC-3 | 0.07 |
| ExC-6 | 0.029 |
| ExC-7 | 0.010 |
| ExY-5 | 0.008 |
| Cpd-2 | 0.046 |
| Cpd-4 | 0.077 |
| HBS-1 | 0.25 |
| HBS-2 | 0.12 |
| Gelatin | 2.12 |
| **Seventh Layer: Interlayer** | |
| Cpd-1 | 0.089 |
| Solid Dispersion Dye ExF-4 | 0.030 |
| HBS-1 | 0.050 |
| Polyethyl Acrylate Latex | 0.83 |
| Gelatin | 0.84 |
| **Eighth Layer: Layer giving interimage effect to a red-sensitive layer** | |
| Silver Iodobromide Emulsion M | 0.560 as silver |
| Cpd-4 | 0.030 |
| ExM-2 | 0.096 |
| ExM-3 | 0.028 |
| ExY-1 | 0.031 |
| ExG-1 | 0.006 |
| HBS-1 | 0.038 |
| HBS-3 | 0.003 |
| Gelatin | 0.58 |
| **Ninth Layer: Low-Speed Green-Sensitive Emulsion Layer** | |
| Silver Iodobromide Emulsion L | 0.39 as silver |
| Silver Iodobromide Emulsion K | 0.28 as silver |
| Silver Iodobromide Emulsion J | 0.35 as silver |
| ExM-2 | 0.36 |
| ExM-3 | 0.045 |
| ExG-1 | 0.005 |
| HBS-1 | 0.28 |
| HBS-3 | 0.01 |
| HBS-4 | 0.27 |
| Gelatin | 1.39 |
| **Tenth Layer: Medium-Speed Green-Sensitive Emulsion Layer** | |
| Silver Iodobromide Emulsion I | 0.45 as silver |
| ExC-6 | 0.009 |
| ExM-2 | 0.031 |
| ExM-3 | 0.029 |
| ExY-1 | 0.006 |
| ExM-4 | 0.028 |
| ExG-1 | 0.005 |
| HBS-1 | 0.064 |
| HBS-3 | $2.1 \times 10^{-3}$ |
| Gelatin | 0.44 |
| **Eleventh Layer: High-Speed Green-Sensitive Emulsion Layer** | |
| Silver Iodobromide Emulsion I | 0.30 as silver |
| Silver Iodobromide Emulsion H | 0.69 as silver |
| ExC-6 | 0.004 |
| ExM-1 | 0.016 |
| ExM-3 | 0.036 |
| ExM-4 | 0.020 |
| ExM-5 | 0.004 |

TABLE 8-continued

| | |
|---|---|
| ExY-5 | 0.003 |
| ExM-2 | 0.013 |
| ExG-1 | 0.005 |
| Cpd-4 | 0.007 |
| HBS-1 | 0.18 |
| Polyethyl Acrylate Latex | 0.099 |
| Gelatin | 1.11 |
| **Twelfth Layer: Yellow Filter Layer** | |
| Yellow Colloidal Silver | 0.010 as silver |
| Cpd-1 | 0.16 |
| Solid Dispersion Dye ExF-6 | 0.153 |
| Oil-Soluble Dye ExF-5 | 0.010 |
| HDS-1 | 0.082 |
| Gelatin | 1.057 |
| **Thirteenth Layer: Low-Speed Blue-Sensitive Emulsion Layer** | |
| Silver Iodobromide Emulsion G | 0.18 as silver |
| Silver Iodobromide Emulsion E | 0.20 as silver |
| Silver Iodobromide Emulsion F | 0.07 as silver |
| ExC-1 | 0.041 |
| ExC-8 | 0.012 |
| ExY-1 | 0.035 |
| ExY-2 | 0.71 |
| ExY-3 | 0.10 |
| ExY-4 | 0.005 |
| Cpd-2 | 0.10 |
| Cpd-3 | $4.0 \times 10^{-3}$ |
| HBS-1 | 0.24 |
| Gelatin | 1.41 |
| **Fourteenth Layer: High-Speed Blue-Sensitive Emulsion Layer** | |
| Silver Iodobromide Emulsion D | 0.75 as silver |
| ExC-1 | 0.013 |
| ExY-2 | 0.31 |
| ExY-3 | 0.05 |
| ExY-6 | 0.062 |
| Cpd-2 | 0.075 |
| Cpd-3 | $1.0 \times 10^{-3}$ |
| HBS-1 | 0.10 |
| Gelatin | 0.91 |
| **Fifteenth Layer: First Protective Layer** | |
| Silver Iodobromide Emulsion S | 0.30 as silver |
| UV-1 | 0.21 |
| UV-2 | 0.13 |
| UV-3 | 0.20 |
| UV-4 | 0.025 |
| F-18 | 0.009 |
| F-19 | 0.005 |
| F-20 | 0.005 |
| HBS-1 | 0.12 |
| HBS-4 | $5.0 \times 10^{-2}$ |
| Gelatin | 2.3 |
| **Sixteenth Layer: Second Protective Layer** | |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.75 |

Sample Nos. 902 to 907 were prepared by replacing Emulsions I and H in the eleventh layer with Em-a to Em-g, which were optimally chemically sensitized and spectrally sensitized.

These samples were subjected to color negative development processing. Conditions such as a developing machine and a developing solution were the same as those in Japanese Patent Application No. 11-246491 (paragraphs 0362–0370).

Further, MTF values of 25 cycle/mm of a cyan image at the time when exposed with a white light of Sample Nos. 902 to 907 were found using commonly used MTF method (Modulation Transfer Function). The results obtained are shown in Table 8.

TABLE 8

| Sample No. | Emulsion Used in 11th Layer | Green Sensitivity | Red Sensitivity | MTF | Remarks |
|---|---|---|---|---|---|
| 902 | Em-a | 100 | 100 | 100 | Comparison |
| 903 | Em-c | 120 | 130 | 125 | Comparison |
| 904 | Em-d | 130 | 140 | 135 | Invention |
| 905 | Em-e | 160 | 175 | 170 | Invention |
| 906 | Em-f | 150 | 165 | 160 | Invention |
| 907 | Em-b | 140 | 150 | 155 | Invention |
| 908 | Em-g | 130 | 140 | 140 | Comparison |

Sensitivity was expressed in relative value taking the sensitivity of Sample No. 902 as 100.

The bigger the numeric value, the higher is the sensitivity. MTF value was expressed in relative value taking the value of Sample No. 902 as 100.

The bigger the numeric value, the higher is the sharpness.

It is clearly seen from the results in Table 8 that the sensitivity of a photographic material increases by the use of the emulsion according to the present invention. Further, it is clearly seen that the highest sensitivity can be obtained by using the grains having the lowest reflectance. It is thought that the reduction of the reflectance of tabular grains causes the increase of light absorption in a film.

Also, it is clearly seen that the sharpness is extremely improved by using the emulsion of the present invention. It is thought that the reduction of the reflectance of tabular grains causes the reduction of light scattering in the film. The effect of the present invention was conspicuous.

Example 7

The thickness dependency of the reflectance of tabular grains is well coincides with the results of calculation based on light scattering. The fact that reflectance can be reduced by making the thickness of a grain extremely small is shown below. 7-1) Preparation of emulsion

Nucleation Process

Into a vessel having a capacity of 4 liters which was equipped with a stirrer were put 1,000 ml of water, 0.5 g of oxidized gelatin, and 0.38 g of potassium bromide, and the content was heated until gelatin was dissolved, thereafter the temperature was reduced to 20° C. and that temperature was maintained. Subsequently, 20 ml of an aqueous solution containing 1 g of silver nitrate and 20 g of an aqueous solution containing 0.7 g of potassium bromide were added to the vessel at the same time for 40 seconds.

Ripening Process

One minute after the above addition, 22 ml of an aqueous solution containing 2.2 g of potassium bromide was added thereto, and 2 minutes after this addition, an aqueous solution comprising 315 g of water having dissolved therein 35 g of trimellited gelatin and $1.6\times10^{-4}$ mol of 1-benzyl-4-phenyl pyridinium chloride was added to the reaction vessel. The temperature of the system was increased to 75° C. over 24 minutes from just after the addition of potassium bromide.

Growing Process

Ten minutes after the temperature increase to 75° C., an aqueous solution containing 180 ml of water having dissolved therein 20 g of trimellited gelatin was added to the reaction solution. Two minutes after, 411 ml of an aqueous solution containing 84 g of silver nitrate was added to the solution at an initial flow rate of 2.47 ml/min and a final flow rate of 17.58 ml/min over 41 minutes with accelerating. At the same time, 370 ml of an aqueous solution containing 61.5 g of potassium bromide was added to the solution at an initial flow rate of 2.22 ml/min and a final flow rate of 15.81 ml/min over 41 minutes with accelerating.

Ninety-nine percent (99%) of the grains immediately before growing process were tabular grains and equivalent-circle diameter measured from electron microphotographs was about 0.4 μm. The thickness obtained from X-ray diffraction (222) peak half band width was 0.017 μm. Ninety-nine percent (99%) of the grains after growing process were also tabular grains and equivalent-circle diameter measured from electron microphotographs was 1.9 μm. The thickness obtained from X-ray diffraction (222) peak half band width was 0.046 μm.

The emulsion containing the above grains before growing and the emulsion containing the grains after growing were respectively coated on a cellulose triacetate film support (Sample Nos. 1001 and 1002). In addition, 12 kinds of emulsions having a thickness of from 0.090 μm to 0.278 μm and the similar coated films were prepared (Sample Nos. 1003 to 1014). The reflectance of these samples was also measured. The coated silver amount was 0.8 g/m$^2$ with any sample. The reflectance of these samples to 450 nm wavelength, 550 nm wavelength and 650 nm wavelength was measured. The thickness and reflectance of the silver halide grains used are shown in Table 9 and FIGS. 7 to 9.

TABLE 9

Thickness of tabular grain and reflectance to the light each having a wavelength of 450 nm, 550 nm and 650 nm

| Sample No. | Grain Thickness (μm) | Reflectance (%) 450 nm | 550 nm | 650 nm |
|---|---|---|---|---|
| Sample 1001 | 0.017 | 30.8 | 21.0 | 14.1 |
| Sample 1002 | 0.046 | 32.9 | 26.8 | 22.2 |
| Sample 1003 | 0.090 | 11.9 | 19.2 | 20.8 |
| Sample 1004 | 0.103 | 10.2 | 13.5 | 17.0 |
| Sample 1005 | 0.113 | 11.1 | 11.3 | 14.7 |
| Sample 1006 | 0.126 | 13.0 | 8.2 | 11.9 |
| Sample 1007 | 0.143 | 16.7 | 8.6 | 9.7 |
| Sample 1008 | 0.155 | 17.9 | 9.7 | 7.0 |
| Sample 1009 | 0.161 | 18.0 | 13.2 | 6.7 |
| Sample 1010 | 0.168 | 17.9 | 13.7 | 7.2 |
| Sample 1011 | 0.177 | 16.6 | 15.4 | 7.8 |
| Sample 1012 | 0.222 | 11.4 | 17.8 | 11.1 |
| Sample 1013 | 0.240 | 12.8 | 18.1 | 15.7 |
| Sample 1014 | 0.278 | 12.8 | 17.0 | 13.4 |

As is apparent from FIGS. 7 to 9, the theoretical value of reflectance and measured value were well coincided. A grain having a thickness of 0.046 μm showed extremely large reflectance, but the reflectance of a grain having a thickness of 0.017 μm decreased as compared with that grain. Therefore, it is possible to reduce the reflected amount of light by extremely reducing a grain thickness.

7-2) Tabular Grains were Produced in the Same Manner as Above

An emulsion to which 1-benzyl-4-phenyl pyridinium chloride aqueous solution of 0.02 M was not added during growing process (the same with Example 7), and emulsions to which were added in an amount of 80 ml, 120 ml and 160 ml respectively were prepared. The addition speed was proportional to the addition speed of the potassium bromide aqueous solution. The thickness and grain size of each silver bromide grain prepared are shown below. Further, of these tabular grains, the proportion of the grains having equivalent-circle diameter of 0.6 μm or less was 10% or less of the total projected area.

| Emulsion | Average Thickness (μm) | Average Equivalent-Circle Diameter (μm) | Reflectance of Grain to Light of 550 nm/ Maximum Reflectance of Grain to Light of 550 nm (26%) | Reflectance of Grain to Light of 650 nm/ Maximum Reflectance of Grain to Light of 650 nm |
|---|---|---|---|---|
| Emulsion 41 | 0.046 | 1.9 | 100% | 93% |
| Emulsion 42 | 0.041 | 2.0 | 96% | 86% |
| Emulsion 43 | 0.036 | 2.1 | 92% | 79% |
| Emulsion 44 | 0.031 | 2.3 | 87% | 70% |

Emulsions 41 to 44 were optimally chemically sensitized and spectrally sensitized in the same manner as the preparing method of Emulsion I in Example 6. Sample Nos. 1101 to 1104 were prepared by replacing Emulsions I and H in the eleventh layer of Example 6 with these emulsions.

Samples prepared were processed in the same manner as in Example 6 and the density of the processed samples were measured with a green filter. The results obtained are shown in Table 10. The sensitivity is the reciprocal of the exposure amount to give the density of (fog +0.2) and the reciprocal of the exposure amount to give the density of (fog +1.5) and expressed by the relative value.

TABLE 10

| Sample No. | Sensitivity [density of (fog + 0.2)] | Sensitivity [density of (fog + 1.5)] | Remarks |
|---|---|---|---|
| Sample 1101 | 100 | 100 | Comparison |
| Sample 1102 | 110 | 105 | Comparison |
| Sample 1103 | 120 | 110 | Comparison |
| Sample 1104 | 140 | 120 | Invention |

It is seen from the results in Table 10 that the width of sensitization broadens when the grain thickness is 90% or less of the thickness which makes the reflected amount of light highest, and the sensitivity of the lower layer expressed by the density of (fog +1.5) is also greatly improved.

Example 8

Emulsions 41 to 44 in Example 7 were subjected to optimal chemical sensitization and spectral sensitization of the red region using the epitaxial sensitization procedure which was used to Emulsions 1A and 1B in the Example in U.S. Pat. No. 5,494,789. Sample Nos. 1201 to 1204 were prepared by replacing Emulsions P and O in the fifth layer of Sample No. 901 with these emulsions.

The density of the development processed sample was measured with a red filter. The results obtained are shown in Table 11. Sensitivity is expressed as the reciprocal of exposure amount to give density of (fog+0.2).

TABLE 11

| Sample No. | Sensitivity [density of (fog + 0.2)] | Remarks |
|---|---|---|
| Sample 1201 | 140 | Invention |
| Sample 1202 | 110 | Comparison |
| Sample 1203 | 105 | Comparison |
| Sample 1204 | 100 | Comparison |

It is clearly seen from the results in Table 11 that the sensitivity of the upper high-speed layer greatly increases when the grain thickness of the medium-speed layer is made the thickness of 90% or more of spectral reflectance.

Example 9

Comparative Example

Emulsion Em-N' was prepared in the same manner as the preparation of Emulsion Em-N in Example 6 except that oxidized gelatin, which was obtained by almost thoroughly oxidizing the methionine of non-modified gelatin having molecular weight of 100,000 by aqueous hydrogen peroxide, was used in place of phthalated gelatin having phthalation rate of 97% and molecular weight of 100,000 used in Emulsion Em-N.

The shape characteristic values of the obtained silver halide grains are shown below.

Average equivalent-circle diameter (variation coefficient): 2.26 μm (25%)

Average thickness (variation coefficient): 0.08 μm (21%)

Average aspect ratio (variation coefficient): 28 (23) Tabularity: 121

Distance between twin planes (variation coefficient): 0.012 μm (22)

The proportion of the tabular grains in the total projected area: 98%

{100} face ratio to the side face: 22%

Average I content (variation coefficient): 5 mol % (6%)

Average Cl content: 1 mol %

Average I content of the surface: 1.8 mol %

The above emulsion was subjected to chemical sensitization and spectral sensitization in the same manner as in the preparation of Emulsion Em-N in Example 6. Sample No. 1301 was prepared by replacing this emulsion with Em-N in Example 6.

Comparative Example

Comparative Sample No. 1302 was prepared in the same manner as the preparation of Sample No. 1301 except that $TiO_2$ fine particles having a diameter of 120 nm and a dispersion degree of 20% were dispersed in a volume fraction of 20% in the gelatin in the sixth layer (high-speed red-sensitive emulsion layer) of Sample No. 1301.

Invention

Sample No. 1303 of the present invention was prepared in the same manner as the preparation of Sample No. 1301 except that $TiO_2$ fine particles having a diameter of 40 nm and a dispersion degree of 20% were dispersed in a volume fraction of 20% in the gelatin in the sixth layer (high-speed red-sensitive emulsion layer) of Sample No. 1301.

Invention

Sample No. 1304 of the present invention was prepared in the same manner as the preparation of Sample No. 1301 except that $TiO_2$ fine particles having a diameter of 40 nm and a dispersion degree of 20% were dispersed in gelatin in the sixth layer (high-speed red-sensitive emulsion layer) of Sample No. 1301 in a volume fraction of 35%.

Relative refractive index, photographic properties and sharpness of the silver halide grain in the sixth layer are shown in Table 12.

The measurement of the relative refractive index of the sixth layers of Sample Nos. 901 and 1301 to 1304 was performed in a manner that the surface of each sample was peeled off and the refractive index of the gelatin in the sixth layer of each sample alone was measured by M-150 Spectral Elipsometer (manufactured by Nippon Bunko Co. Ltd.). The relative refractive index of the silver halide grain contained in the sixth layer of each sample was estimated.

The density of each of processed Sample Nos. 901, 1301 to 1304 was measured with a red filter. Red sensitivity is expressed as the reciprocal of exposure amount to give density of (fog+0.2).

Further, MTF values of 25 cycle/mm of a cyan image at the time when exposed with a white light of Sample Nos. 901, 1301 to 1304 were found using commonly used MTF method (Modulation Transfer Function).

TABLE 12

| Sample No. | Emulsion Used in 6th Layer | Relative Refractive Index | Red Sensitivity | MTF | Remarks |
|---|---|---|---|---|---|
| 901 | Em-N | 0.65 | 100 | 100 | Comparison |
| 1301 | Em-N' | 0.65 | 109 | 155 | Comparison |
| 1302 | Em-N' | 0.80 | 130 | 101 | Comparison |
| 1303 | Em-N' | 0.80 | 130 | 155 | Invention |
| 1304 | Em-N' | 0.95 | 145 | 155 | Invention |

It is clearly seen from the results in Table 12 that the sensitvity increase of Sample No. 1301 is slow as compared with Sample No. 901 although the aspect ratio of the high-speed red-sensitive emulsion layer was heightened.

Further, the relative refractive index of Sample No. 1302 was increased to 0.80, as a result, the red sensitivity showed a tendency to increase. On the other, however, the sharpness resulted in deterioration as compared with Sample No. 1301. This is because $TiO_2$ particles dispersed in gelatin caused light scattering in the layer due to the large particle size.

On the other hand, in Sample No. 1303 of the present invention which contains $TiO_2$ fine particles having a particle diameter of 40 nm, the sharpness was largely improved while maintaining the improvement in sensitivity.

In Sample No. 1304 of the present invention in which the volume fraction of $TiO_2$ fine particles was increased, the relative refractive index was further approaching 1, as a result, red sensitivity largely increased while maintaining sharpness.

From the above results, the present invention can conspicously improve both sensitivity and sharpness.

Example 10

Sample Nos. 1402 to 1408 were prepared in the same manner as the reparation of Sample Nos. 902 to 908 in Example 6 except that $TiO_2$ fine particles having a diameter of 40 nm and a dispersion degree of 20% were dispersed in a volume fraction of 30% in the gelatin in the eleventh layer of Sample Nos. 902 to 908. The results of evaluation conducted in the same manner as in Example 6 are shown in Table 13.

TABLE 13

| Sample No. | Emulsion Used in 11th Layer | Green Sensitivity | Red Sensitivity | MTF | Remarks |
|---|---|---|---|---|---|
| 1402 | Em-a | 100 | 100 | 100 | Invention |
| 1403 | Em-c | 123 | 133 | 128 | Invention |
| 1404 | Em-d | 138 | 147 | 145 | Invention |
| 1405 | Em-e | 173 | 188 | 179 | Invention |
| 1406 | Em-f | 164 | 177 | 168 | Invention |
| 1407 | Em-b | 159 | 157 | 166 | Invention |
| 1408 | Em-g | 145 | 146 | 147 | Invention |

Sensitivity is expressed by the relative value with the sensitivity of Sample No. 1402 as 100. The bigger the numeric value, the higher is the sensitivity.

MTF is expressed by the relative value with the MTF value of Sample No. 1402 as 100. The bigger the numeric value, the higher is the sharpness.

It is clearly seen from the comparison with the results in Table 8 that when the emulsions according to the present invention are used in combination with $TiO_2$ fine particles, higher sensitization and the increase in sharpness are further improved.

Example 11

Sample Nos. 1501 to 1504 were prepared in the same manner as the preparation of Sample Nos. 1101 to 1104 in Example 7 except that $TiO_2$ fine particles having a diameter of 40 nm and a dispersion degree of 20% were dispersed in a volume fraction of 20% in the gelatin in the eleventh layer of Sample Nos. 1101 to 1104. The results of evaluation conducted in the same manner as in Example 7 are shown in Table 14.

TABLE 14

| Sample No. | Sensitivity [density of (fog + 0.2)] | Sensitivity [density of (fog + 1.5)] | Remarks |
|---|---|---|---|
| Sample 1501 | 100 | 100 | Invention |
| Sample 1502 | 115 | 107 | Invention |
| Sample 1503 | 127 | 113 | Invention |
| Sample 1504 | 168 | 135 | Invention |

It is clearly seen from the comparison with the results in Table 10 that when the emulsions according to the present invention are used in combination with $TiO_2$ fine particles, higher sensitization and the increase in sharpness are further improved.

Example 12

Sample Nos. 1601 to 1604 were prepared in the same manner as the preparation of Sample Nos. 1201 to 1204 in Example 8 except that $TiO_2$ fine particles having a diameter of 40 nm and a dispersion degree of 20% were dispersed in a volume fraction of 20% in the gelatin in the eleventh layer of Sample Nos. 1201 to 1204. The results of evaluation conducted in the same manner as in Example 8 are shown in Table 15.

TABLE 15

| Sample No. | Sensitivity [density of (fog + 0.2)] | Remarks |
|---|---|---|
| Sample 1601 | 157 | Invention |
| Sample 1602 | 115 | Invention |
| Sample 1603 | 113 | Invention |
| Sample 1604 | 100 | Invention |

It is clearly seen from the comparison with the results in Table 11 that when the emulsions according to the present invention are used in combination with $TiO_2$ fine particles, higher sensitization is further improved.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least one silver halide emulsion layer which is exposed and processed with a development process comprising a developing process and a fixing process, wherein said silver halide emulsion layer contains, in the dispersion medium phase of the emulsion, one or more kinds of inorganic fine particles having a refractive index of from 1.62 to 3.30 to the light having a wavelength of 500 nm, the total weight of said fine particles contained in the unit volume of said dispersion medium phase is from 1.0 to 95 wt %, the dispersion medium phase containing said fine particles is substantially transparent to the photosensitive peak wavelength light of said emulsion layer, and the residual silver halide grains in the photographic material after development are removed from the photographic material by a fixing treatment;

wherein at least one silver halide emulsion layer contains inorganic fine particles having a particle diameter of 100 nm or less;

wherein the inorganic fine particles are oxides containing as a component at least one element selected from the group consisting of Ti, Sn, Al, Pb, Ba, In, Si, Sb, Ge, La, Zr, W, Ta and Nb.

2. The silver halide photographic material as claimed in claim 1, wherein from 50 to 100% of the total projected area of the silver halide grains in said at least one silver halide emulsion layer are tabular grains having an aspect ratio (diameter/thickness) of from 2.0 to 300, a thickness of from 0.01 to 0.50 $\mu$m, and a diameter of from 0.1 to 30 $\mu$m.

3. The silver halide photographic material as claimed in claim 2, wherein said tabular grains have a variation coefficient of thickness distribution of from 0.01 to 0.30 and a variation coefficient of diameter distribution of from 0.01 to 0.30.

4. The silver halide photographic material as claimed in claim 1, wherein the number of said inorganic fine particles is from 0.5 to $10^{12}$ per one tabular grain.

5. The silver halide photographic material as claimed in claim 1, wherein said photographic material is a color photographic material comprising a support having multilayer-coated thereon at least a blue-sensitive layer, a green-sensitive layer and a red-sensitive layer.

6. The silver halide photographic material as claimed in claim 5, wherein said blue-sensitive layer, green-sensitive layer and red-sensitive layer respectively comprise one or more layers, and when taking it that said blue-sensitive layer comprises $B_1$, $B_2$, $B_3$ . . . $B_{m1}$, green-sensitive layer comprises $G_1$, $G_2$, $G_3$ . . . $G_{m1}$, and red-sensitive layer comprises $R_1$, $R_2$, $R_3$ . . . $R_{m1}$, in order nearer to the subject, the silver halide grains in from 1 to 3 layers of $B_1$, $G_1$ and $R_1$ are tabular grains wherein from 50 to 100% of the total projected area of the silver halide grains in said at least one silver halide emulsion layer are tabular grains having an aspect ratio (diameter/thickness) of from 2.0 to 300, a thickness of from 0.01 to 0.50 $\mu$m, and a diameter of from 0.1 to 30 $\mu$m.

7. The silver halide photographic material as claimed in claim 5, wherein said blue-sensitive layer is arranged nearest to the subject, said blue-sensitive layer comprises one or more layers, the silver halide grains contained in at least the layer having the highest sensitivity of said one or more layers are tabular grains wherein from 50 to 100% of the total projected area of the silver halide grains in said at least one silver halide emulsion layer are tabular grains having an aspect ratio (diameter/thickness) of from 2.0 to 300, a thickness of from 0.01 to 0.50 $\mu$m, and a diameter of from 0.1 to 30 $\mu$m, and the thickness of said tabular grains is prescribed so that the reflected light strength ($A_3$) to the photosensitive peak wavelength light of said green-sensitive layer and the photosensitive peak wavelength light of said red-sensitive layer falls within the range defined by equation (a-1):

Equation (a-1): Main planes of various tabular grains having the same condition excepting the thicknesses are subjected to incidence at the incident angle of 5° with the beam of said photosensitive peak wavelength light, the reflected light strength is measured in the direction of the reflection angle of 5°, and when the reflected light strength with the highest strength is taken as $A_1$, and the reflected light strength with the lowest strength is taken as $A_2$, the range of said reflected light strength ($A_3$) is defined as $\{A_2 \sim [A_2 + b_1(A_1 - A_2)]\}$, wherein $b_1$ is 0.47.

8. A silver halide color photographic material comprising a support having provided thereon at least one red-sensitive silver halide emulsion layer, at least one green-sensitive silver halide emulsion layer, and at least one blue-sensitive halide emulsion layer, wherein said silver halide color photographic material comprises at least one layer of silver halide emulsion layers containing inorganic fine particles having a particle diameter of 100 nm or less, at least one spectral sensitive silver halide emulsion layer comprises two or more emulsion layers containing tabular silver halide grains, and the average grain thickness of the grains contained in at least one layer of these two or more layers other than the layer farthest from the support falls within the range of the thickness which gives the spectral reflectance of 80% or more of the maximum spectral reflectance of the tabular grains, wherein the layer farthest from the support comprises a higher speed emulsion than any other spectral sensitive layer in the silver halide photographic material.

9. The silver halide color photographic material as in claim 8 wherein the layer farthest from the support comprises at least one silver halide emulsion layer containing tabular silver halide grains, the ratio of the tabular silver halide grains having an equivalent-circle diameter of 0.6 $\mu$m or less among said tabular silver halide grains is 20% or less in terms of the projected area, the average thickness of said tabular grains is smaller than the thickness of the grains in said layer which give the maximum value of spectral reflectance, and the spectral reflectance at said average thickness is 90% or less of said maximum value of spectral reflectance.

10. A silver halide photographic material as claimed in claim 8 wherein the layer farthest from the support comprises at least one silver halide emulsion layer containing tabular silver halide grains, and said tabular grains have a lower spectral reflectance than the spectral reflectance of tabular silver chloride grains having the same thickness, wherein said at least one layer of the silver halide emulsion layers contains inorganic fine particles and said inorganic fine particles have a particle diameter of 100 nm or less.

11. A silver halide photographic material as claimed in claim 8 wherein the layer farthest from the support comprises at least one silver halide emulsion layer containing tabular silver halide grains, the ratio of the tabular silver halide grains having an equivalent-circle diameter 0.6 $\mu$m or less among said tabular silver halide grains is 20% or less in terms of the projected area, the average thickness of said tabular grains is smaller than the thickness of the grains in said layer which give the maximum value of spectral reflectance, and the spectral reflectance at said average thickness is 90% or less of said maximum value of spectral reflectance, wherein said at least one layer of the silver halide emulsion layers comprises inorganic fine particles and said inorganic fine particles have a particle diameter of 100 nm or less.

12. A silver halide color photographic material comprising a support having provided thereon at least one red-sensitive silver halide emulsion layer, at least one green-sensitive silver halide emulsion layer, and at least one blue-sensitive silver halide emulsion layer, wherein at least one silver halide emulsion layer contains inorganic fine particles having a particle diameter of 0.04 $\mu$m or less and silver halide tabular grains having a thickness of less than 0.09 $\mu$m.

13. A silver halide color photographic material comprising a support having provided thereon at least one red-sensitive silver halide emulsion layer, at least one green-sensitive silver halide emulsion layer, and at least one blue-sensitive halide emulsion layer, wherein said silver halide color photographic material comprises at least one silver halide emulsion layer comprising tabular silver halide grains, wherein said tabular grains have a lower spectral reflectance that the spectral reflectance of tabular silver chloride grains having the same thickness.

14. A silver halide color photographic material as in claim 13 wherein said at least one layer of the silver halide emulsion layers comprises inorganic fine particles and said inorganic fine particles have a particle diameter of 100 nm or less.

15. A silver halide color photographic material comprising a support having provided thereon at least one red-sensitive silver halide emulsion layer, at least one green-sensitive silver halide emulsion layer, and at least one blue-sensitive halide emulsion layer, wherein said silver halide color photographic material comprises at least one silver halide emulsion layer comprising tabular silver halide grains, the ratio of the tabular silver halide grains having an equivalent-circle diameter of 0.06 $\mu$m or less among said tabular silver halide grains is 20% or less in terms of the projected area, the average thickness of said tabular grains is smaller than the thickness of the grains in said layer which give the maximum value of spectral reflectance, and the spectral reflectance at said average thickness is 90% or less of said maximum value of spectral reflectance.

16. A silver halide color photographic material as in claim 15 wherein said at least one layer of the silver halide emulsion layers comprises inorganic fine particles and said inorganic fine particles have a particle diameter of 100 nm or less.

* * * * *